United States Patent [19]

Morokawa

[11] 3,948,036

[45] Apr. 6, 1976

[54] ELECTRONIC TIMEPIECE

[75] Inventor: Shigeru Morokawa, Higashiyamato, Japan

[73] Assignee: Citizen Watch Co., Ltd., Tokyo, Japan

[22] Filed: Dec. 13, 1974

[21] Appl. No.: 532,593

[30] Foreign Application Priority Data

Dec. 24, 1973 Japan ..... 48-2427

[52] U.S. Cl. ..... 58/23 R; 58/24 R; 58/85.5; 58/152 H

[51] Int. Cl.² G04C 3/00; G04C 13/02; G04B 27/00; G04B 37/12

[58] Field of Search ..... 58/23 R, 24–26, 58/50 R, 85.5, 152 H

[56] References Cited

UNITED STATES PATENTS

| | | | |
|---|---|---|---|
| 3,553,957 | 2/1969 | Dome et al. | 58/23 A |
| 3,643,419 | 2/1972 | Motta | 58/23 R |
| 3,777,471 | 12/1973 | Koehler et al. | 53/50 R |
| 3,841,087 | 10/1974 | Kikuchi | 58/23 R |

*Primary Examiner*—Edith Simmons Jackmon
*Attorney, Agent, or Firm*—Sherman & Shalloway

[57] ABSTRACT

An electronic timepiece comprising a plurality of time keep mechanisms adapted to be parallel operated, for example, an electrical time keep means and a mechanical time keep means, is disclosed. The electronic timepiece comprises a time set mechanism which can read out an information of mutual relation between a standard time and a kept time at an instant upon receipt of a standard time signal which is exteriorly supplied as an input and memorize said information and which can precisely synchronize the timepiece during its time keep operation with a standard timepiece based on said memorized information.

18 Claims, 25 Drawing Figures

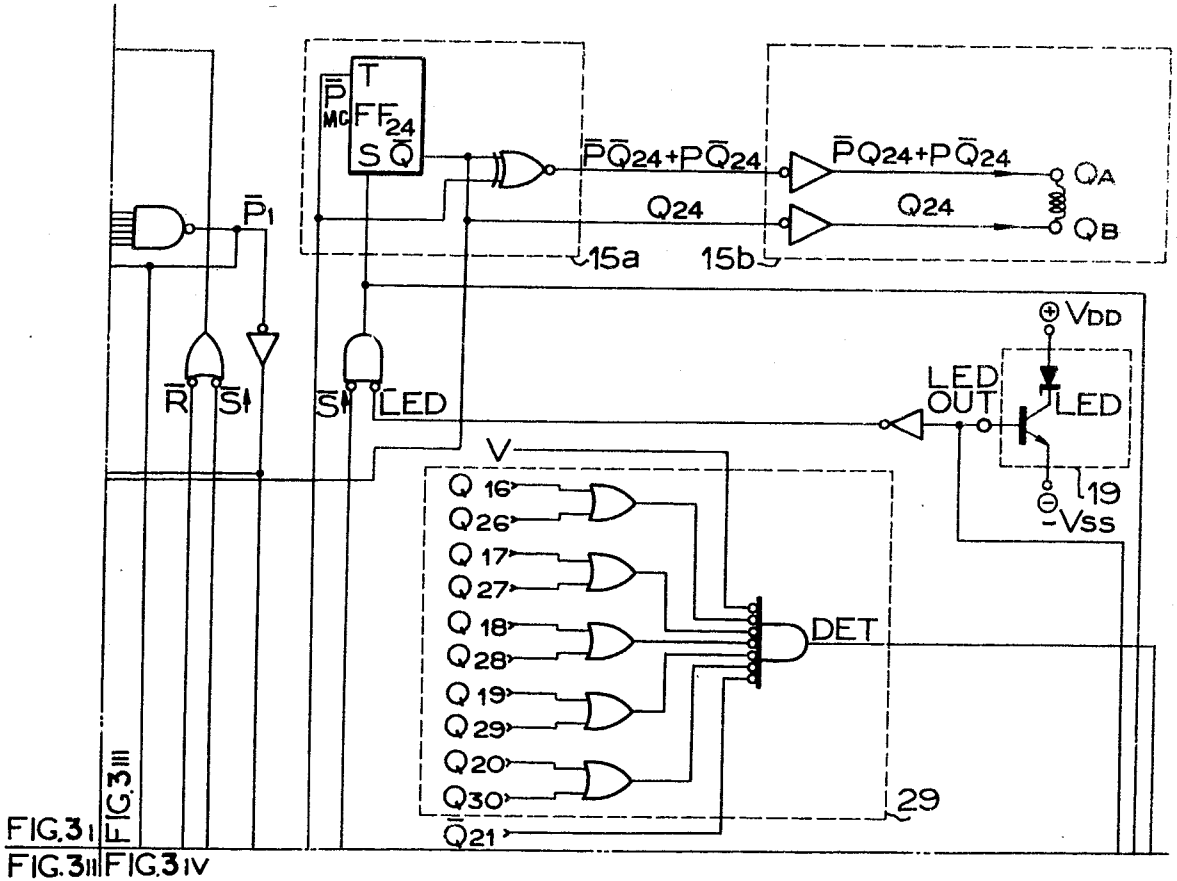
FIG. 3III

ELECTRONIC TIMEPIECE

BACKGROUND OF THE INVENTION

This invention relates to a highly precise electronic timepiece which comprises a highly precise time reference signal supply source and more particularly to an electronic timepiece comprising a time set mechanism which is capable of easily, reliably and precisely setting time to a time reference signal and which can provide a highly reliable time holding faculty.

In electronic timepieces, it has been the common practice to use a frequency reference signal generator, for example, a crystal oscillator using a crystal oscillating element for the purpose of obtaining a time unit signal. Such electronic timepiece provides accuracy which is significantly higher than that of a mechanical timepiece and an electrical timepiece which make use of a mechanical oscillator in general and a synchronous motor using a commercial electric source in general. A highly precise electronic timepiece has already been proposed to provide accuracy on the order of 0.03 to 0.3 second a day. Such highly precise timepiece can exhibit given property only when it is provided with a time correction mechanism which is reliable in operation. Because, the correct time is displayed by precisely setting the time to be displayed, that is, by precisely setting the kept time of the timepiece per se to a standard time being observed.

In a prior art time set mechanism, "hour" and "minute" are corrected by operating a operating mechanism such as a winding crown, while "second" is corrected by temporarily stopping the stepwise movement of a second hand or by using a return mechanism such as a heart-shaped cam. The return mechanism causes the second hand to return to a "0 second" position and to start again when the second hand coincides with the standard time.

Such mechanical operation, however, results in at least 0.2 second slowness in average when a user corrects the display time with respect to the standard time depending on the user's skill. In addition, various kinds of errors are produced dependent on whether the user pushes the correction button only one time or he keeps up his button push operation. The value of these errors becomes far larger than the error inherent to the timepiece per se and eventually arrived at several seconds.

SUMMARY OF THE INVENTION

An object of the invention is to provide an electronic timepiece comprising a correction mechanism which can correct time in an easy and precise manner.

Another object of the invention is to provide an electronic timepiece which is simple in construction as a whole inclusive of a time correction mechanism and which can incorporate essential electric circuit elements into an integral circuit.

A further object of the invention is to provide an electronic timepiece which, when a plurality of instructions are supplied in superimposed relation to a time keep mechanism of the timepiece, can select the most important instruction so as to ensure the basic function of the timepiece.

A still further object of the invention is to provide an electronic timepiece which can display the normal time keep operation during the correcting operation of times.

A feature of the invention is the provision of an electronic timepiece comprising two time keep means which can effect time keep operation independently from each other in response to the same time unit signal, one of these two time keep means utilizing a pure electronic means so as to effect the time keep operation and the other time keep means utilizing a mechanical means so as to effect the time keep operation. In the specification, the former time keep means is called as an electrical time keep means and the latter time keep means is called as a mechanical time keep means.

The kept time of the mechanical time keep means is detected every one period (for example 60 seconds) of its minimum unit (for example second) and is compared with the starting point of one period of the kept time of the electrical time keep means which can operate in the same period as that of the mechanical time keep means. If the kept time of the mechanical time keep means is deviated from that of the electrical time keep means, the former kept time is brought into in coincidence with the latter kept time, thereby making the former kept time in synchronism with the latter kept time.

If 0 second which is displayed in deviated from 0 second of a standard time exteriorly supplied as an input, a correcting signal delivered from a manually operable correction mechanism is used to correct the kept time of the electrical time keep means and then correct the kept time of the mechanical time keep means which is in synchronism with the kept time of the electrical time keep means.

DESCRIPTION OF THE PREFERRED EMBODIMENTS

Figure 1:
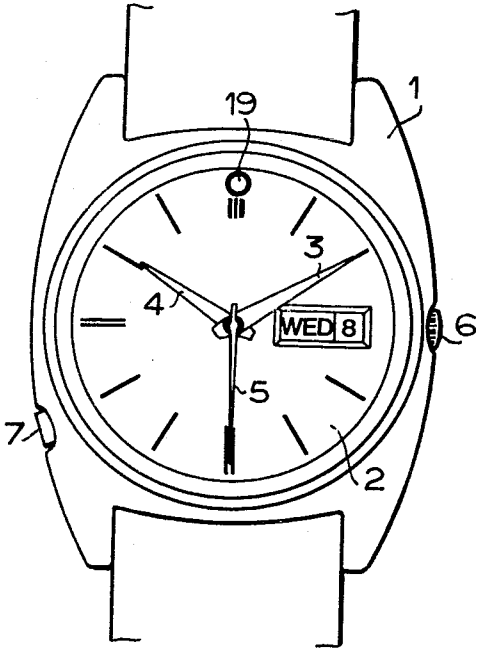
FIG. 1 is a front elevation of an electronic timepiece according to the invention.

An electronic timepiece shown in FIG. 1 is constructed as a wrist watch and comprises a casing 1 enclosing a time keep mechanism to be described later; a time display mechanism consisting of a dial 2, hour hand 3, minute hand 4 and second hand 5; a stem 6 adapted to be operated in the case of correcting times displayed by the hour hand 3 and the minute hand 4, respectively; a button 7 for correcting the position of the second hand 5 and a display part 19 which makes use of a light emitting diode. The appearance of the timepiece shown in FIG. 1 is a mere example and the invention is not limited to the appearance shown in FIG. 1.

Figures 1, 2:
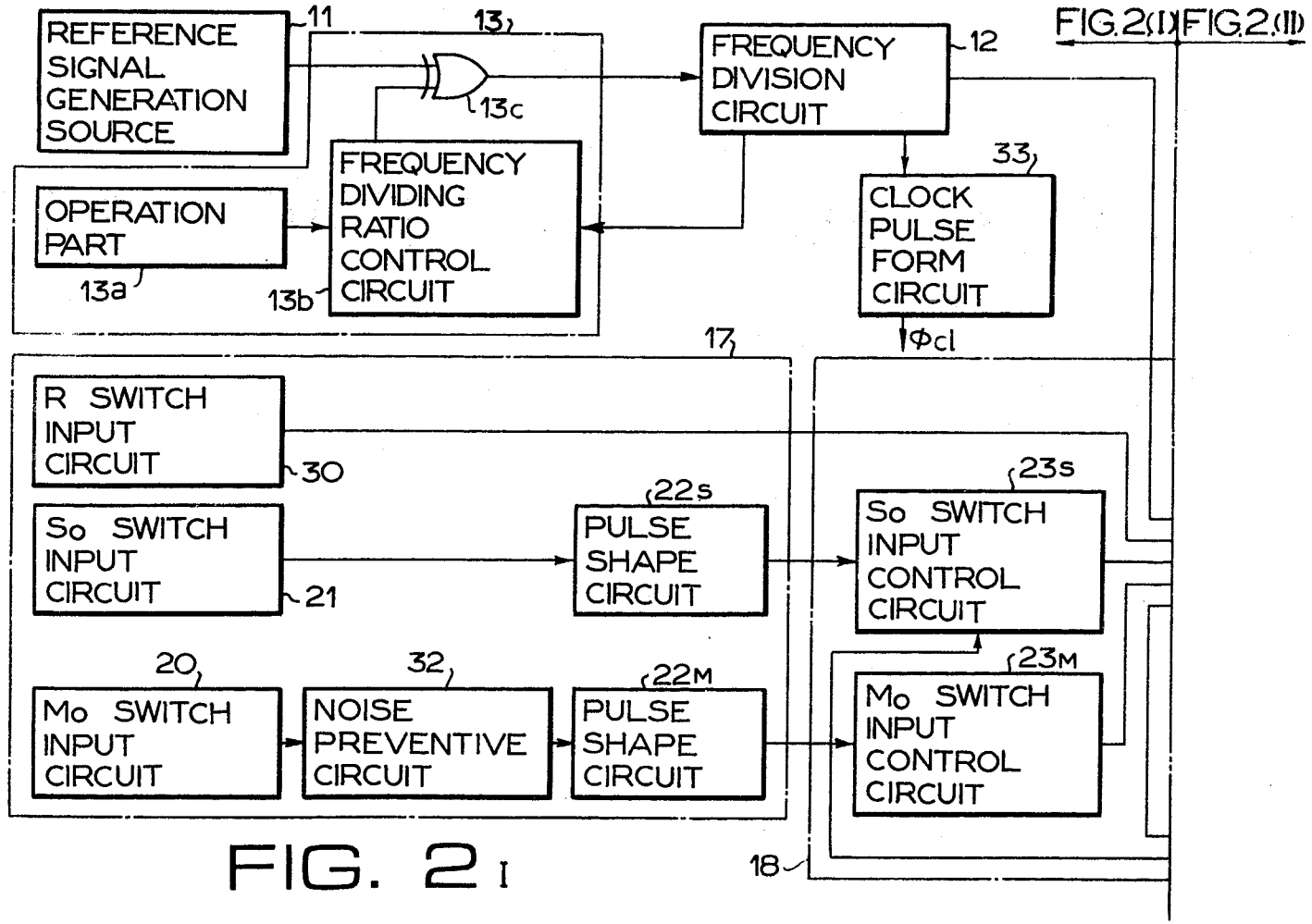
FIG. 2 is a block diagram showing the main parts which are essential for the electronic timepiece according to the invention.
Figure 2:
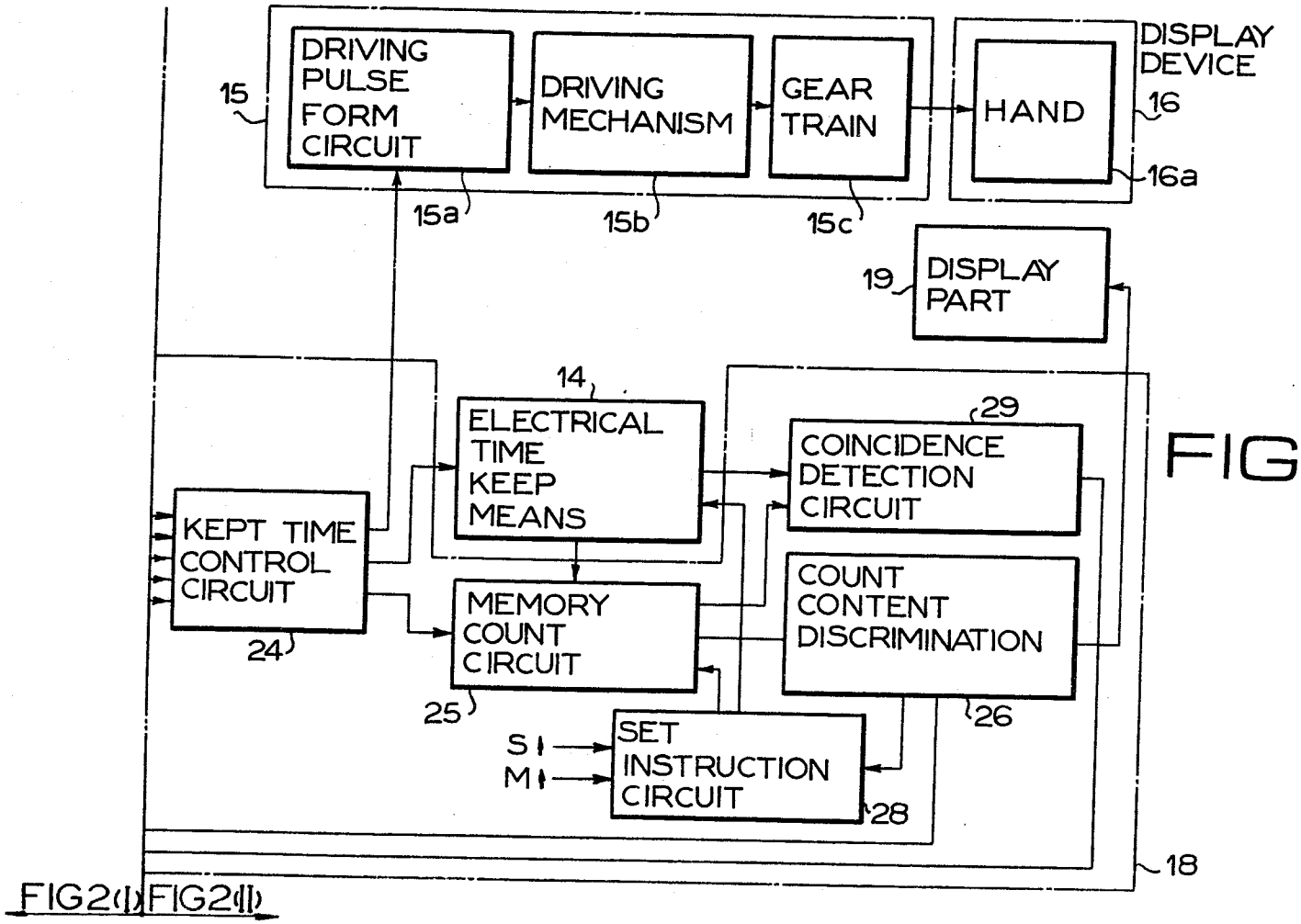

As shown in FIG. 2, the timepiece mechanism enclosed in the casing 1 shown in FIG. 1 comprises a reference signal generation source 11, a frequency division circuit 12, a frequency regulation means 13 for controlling the frequency dividing ratio of the frequency division circuit 12, an electrical time keep means 14 and a mechanical time keep means 15 each adapted to receive a time unit signal delivered from the frequency division circuit 12 so as to effect time keep operation, a display device 16 for displaying the time kept by the mechanical time keep means 15, a control mechanism 17 for controlling the electrical time keep means and the mechanical time keep means, respectively, and an electrical control device 18 for controlling the electrical time keep means 14 and the mechanical time keep means 15 by means of a signal delivered from the control mechanism 17.

The above mentioned frequency regulation means 13 consists of an operating part 13*a*, a frequency dividing ratio control circuit 13*b* and an EXCLUSIVE-OR gate 13*c*. A part of signals delivered from the frequency division circuit 12 is supplied as a clock pulse signal $\phi cl_{12}$ through a clock pulse form circuit 33.

The above mentioned mechanical time keep means 15 consists of a driving pulse form circuit 15*a*, a driving mechanism 15*b* and a gear train 15*c*. The above mentioned display device 16 is provided with a hand 16*a* driven by the gear train 15*c*.

The above mentioned control mechanism 17 consists of a R switch input circuit 30, a $S_o$ switch input circuit 21, a pulse shape circuit 22S, a $M_o$ switch input circuit 20, a noise preventive circuit 32 and a pulse shape circuit 22M. The above mentioned electrical control device 18 consists of a $S_o$ switch input control circuit 23M, a kept time control circuit 24, a memory count circuit 25, a count content discrimination circuit 26, a coincidence detection circuit 29 and a set instruction circuit 28. A display part 19 consists of a light emitting diode adapted to be turned on and off in response to the signal delivered from the above mentioned count content discrimination circuit 26.

The above mentioned reference signal generation source 11 is an oscillator inclusive of a crystal oscillator the frequency of the output signal of which is delivered into a given value by means of the frequency division circuit 12. In prior art electronic timepieces, the frequency divided signal directly drives the mechanical time keep means 15 to display the time by means of the hand 16*a*.

The electronic timepiece according to the invention further comprises the control mechanism 17, electrical time keep means 14 and electrical control device 18.

A time unit signal (frequency is, for example, 1 Hz) delivered from the frequency division circuit 12 passes through the kept time control circuit 24 and is counted by the electrical time keep means 14, the count value being memorized by the memory count circuit 25. In the case of the normal operation of the timepiece, the count value of the electrical time keep means 14 coincides with that of the memory count circuit 25. At this time, the output from the coincidence detection circuit 29 is operated to supply the time keep unit signal from the kept time control circuit 24 to the mechanical time keep means 15. Provision is made of a $M_o$ switch which automatically becomes on for a short time by means of a cam mechanism interlocked with the second hand shaft every time the second had of the hand 16*a* arrives at 0 second position. When the $M_o$ switch is turned on, the kept time of the mechanical time keep means 15 coincides with the kept time of the electrical time keep means 14 so that no difference between the respective kept times occurs.

The $S_o$ switch is adapted to be manually operated when an exterior standard time becomes "0 second". If the kept time of the electrical time keep means 14 is other than 0 second when the $S_o$ switch is turned on, this kept time does not coincide with the standard time. If the kept time of the electrical time keep means 14 is between 1 second and 29 seconds when the $S_o$ switch is turned on, it is considered that this kept time is fast with respect to the standard time. If the kept time of the electrical time keep means 14 is beteween 30 seconds and 59 seconds when the $S_o$ switch is turned on, it is considered that this kept time is slow with respect to the standard time. The correction of such "fast" and "slow" kept times is effected such that the kept time of the electrical time keep means 14 is set to 0 second when the $S_o$ switch is turned on, that at the same time in the case of fast kept time, the electrical time keep means 14 only is made fast at a normal speed while keeping the mechanical time keep means 15 in its awaiting condition, that in the case of slow kept time, the normal time keep operation of the electrical time keep means 14 is effected to fast feed the mechanical time keep means 15 so as to overtake the kept time of the electrical time keep means 14.

That is, when the $S_o$ switch is turned on, a synchronizing pulse is formed by the pulse shape circuit 22S. This synchronizing pulse is supplied through the $S_o$ switch input control circuit 23S to the kept time control circuit 24. This circuit 24 receives a signal from the count content discrimination circuit 26 adapted to discriminate the time kept by the memory count circuit 25 between 1 second to 29 seconds and 30 seconds to 59 seconds and delivers any one of set signal, reset signal, 32 Hz signal, 1 Hz signal and stop instruction signal to the electrical time keep means 14, memory count circuit 25 and set instruction circuit 28 in response to the content thus discriminated. At this time, the erroneous time component between the exterior standard time and the time kept by the electrical time keep means 14 is measured and memorized by the electrical time keep means 14 or the memory count circuit 25. At that time at which the time kept by the electrical time keep means 14 coincides with the standard time, respective counters coincides with each other and the coincidence content of which is detected by the coincidence detection circuit 29 whose signal is supplied to the $S_o$ switch input control circuit 23S which delivers an instruction signal to the kept time control circuit 14 so as to complete the time correcting operation.

The $M_o$ switch serves to bring the time kept by the mechanical time keep means 15 into coincidence with the time kept by the electrical time keep means 14 in the same manner as in the case of the $S_o$ switch.

As seen from the above, the electric timepiece can correct the time in an extremely precise manner by pushing the $S_o$ switch once at the 0 second.

The R switch input circuit 30 is used at those times of the standard time which are other than 0 second and serves to start the normal operation of the second hand after the second hand has been stopped and then set to the standard time. The R switch input circuit 30 plays a role of assisting the function of the $S_o$ switch.

Figure 3I:
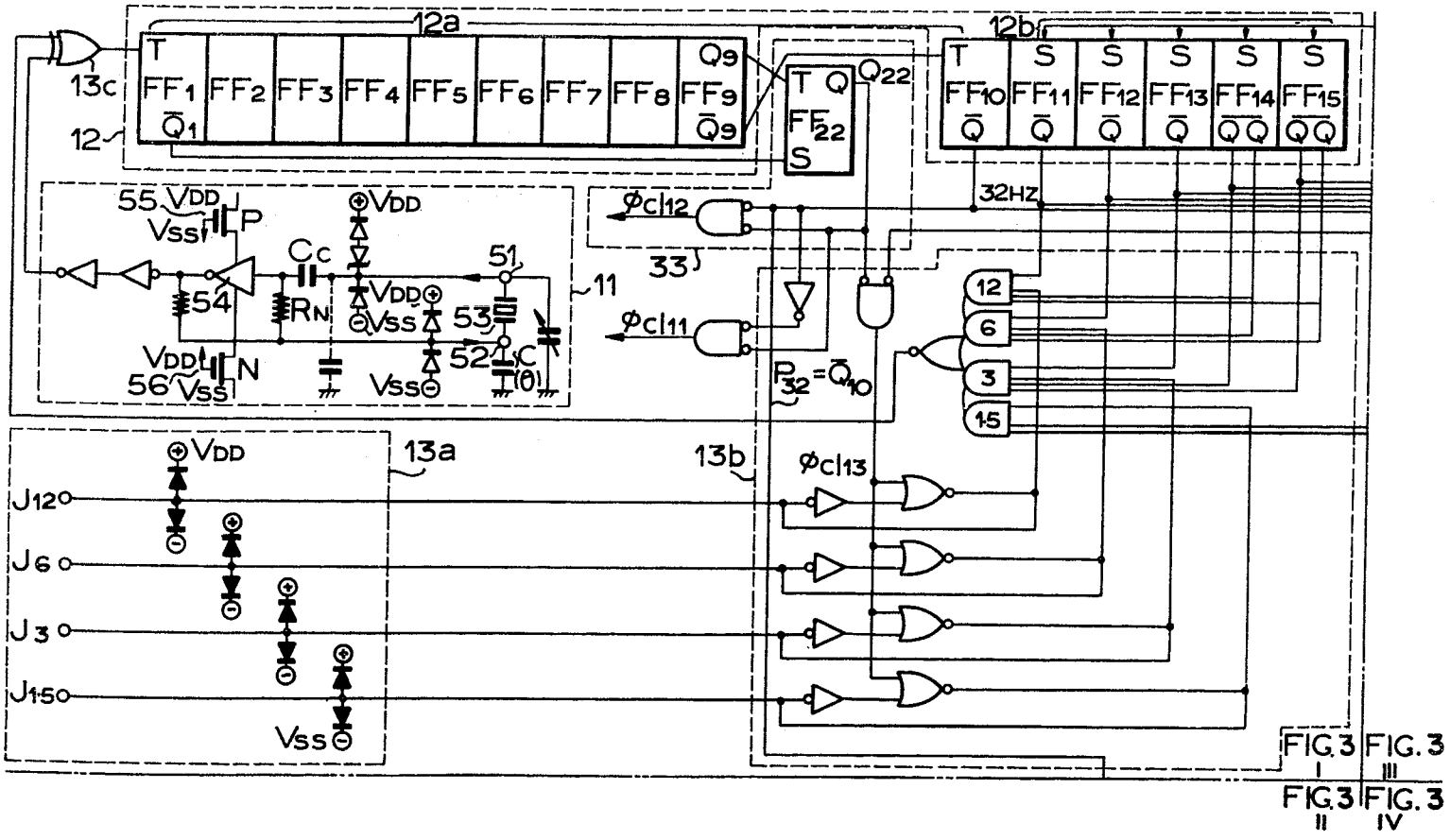
FIG. 3 is a block diagram showing in greater detail the main parts which are essential for the electronic timepiece according to the invention.
Figure 3I:
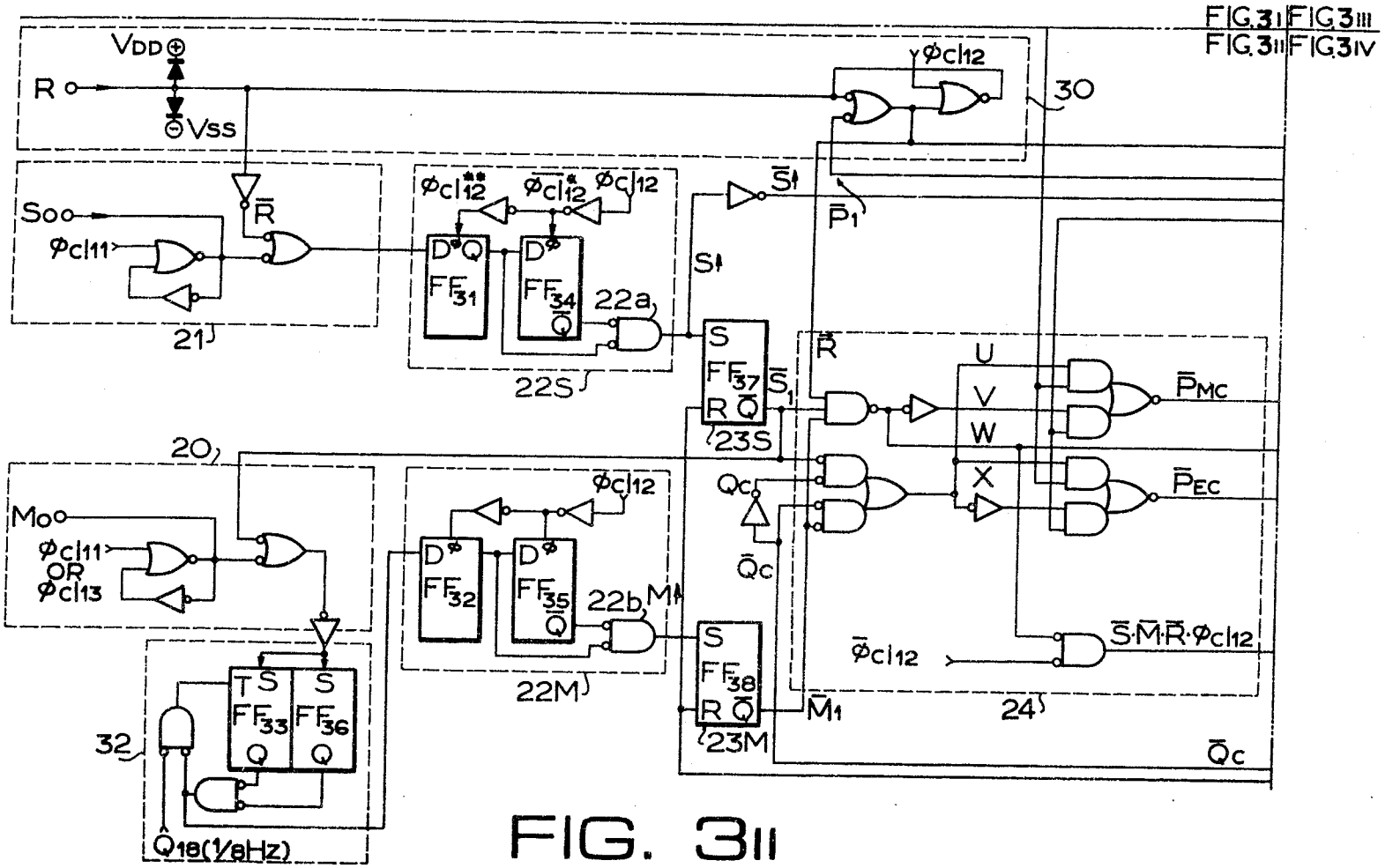
Figure 3V:
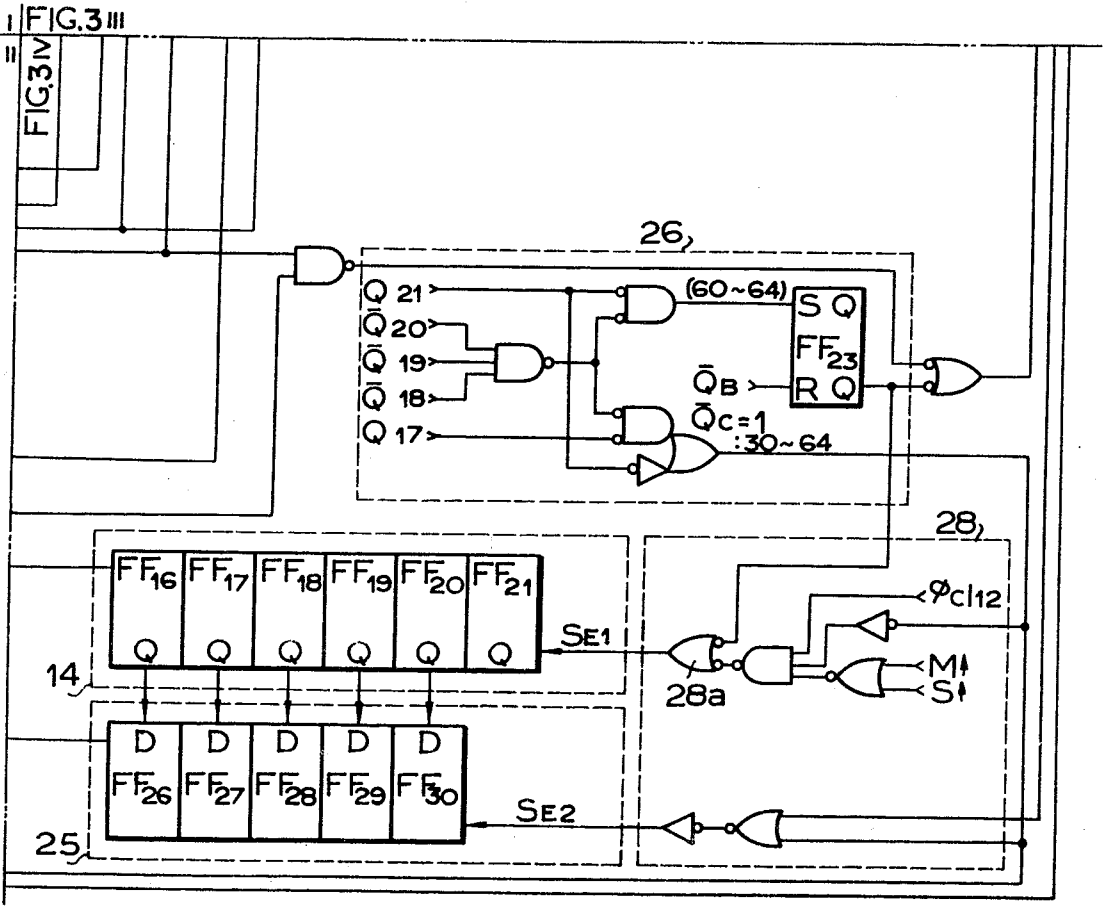
Figure 4:
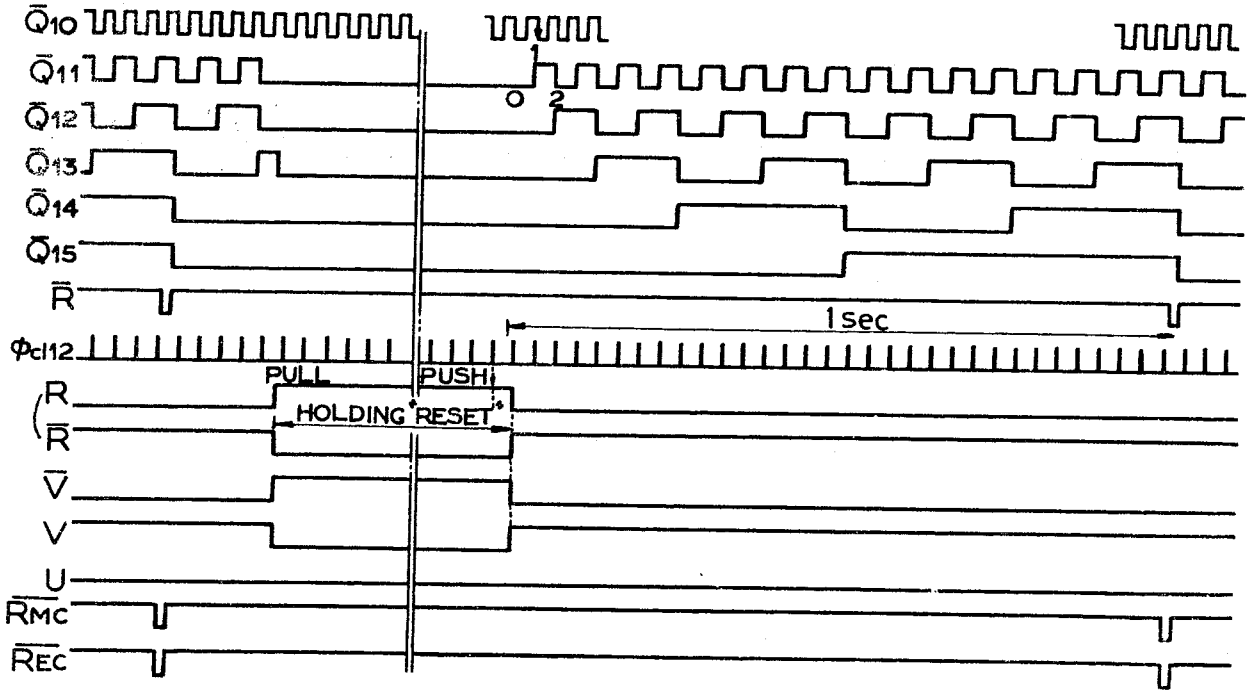
FIGS. 4 to 8 are timing charts showing the timing of various signals at various parts shown in FIG. 3.
Figure 5:
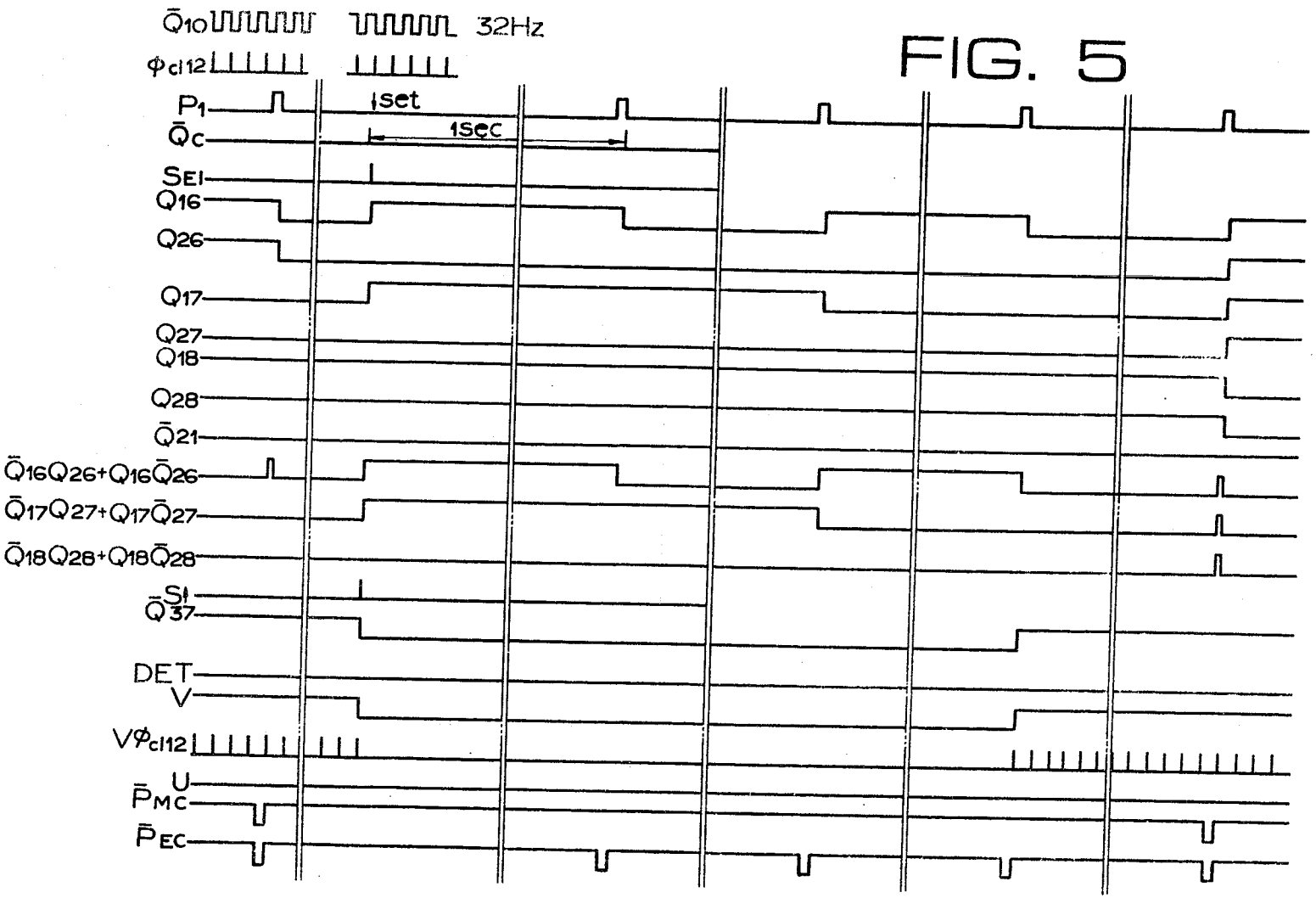
Figure 6:
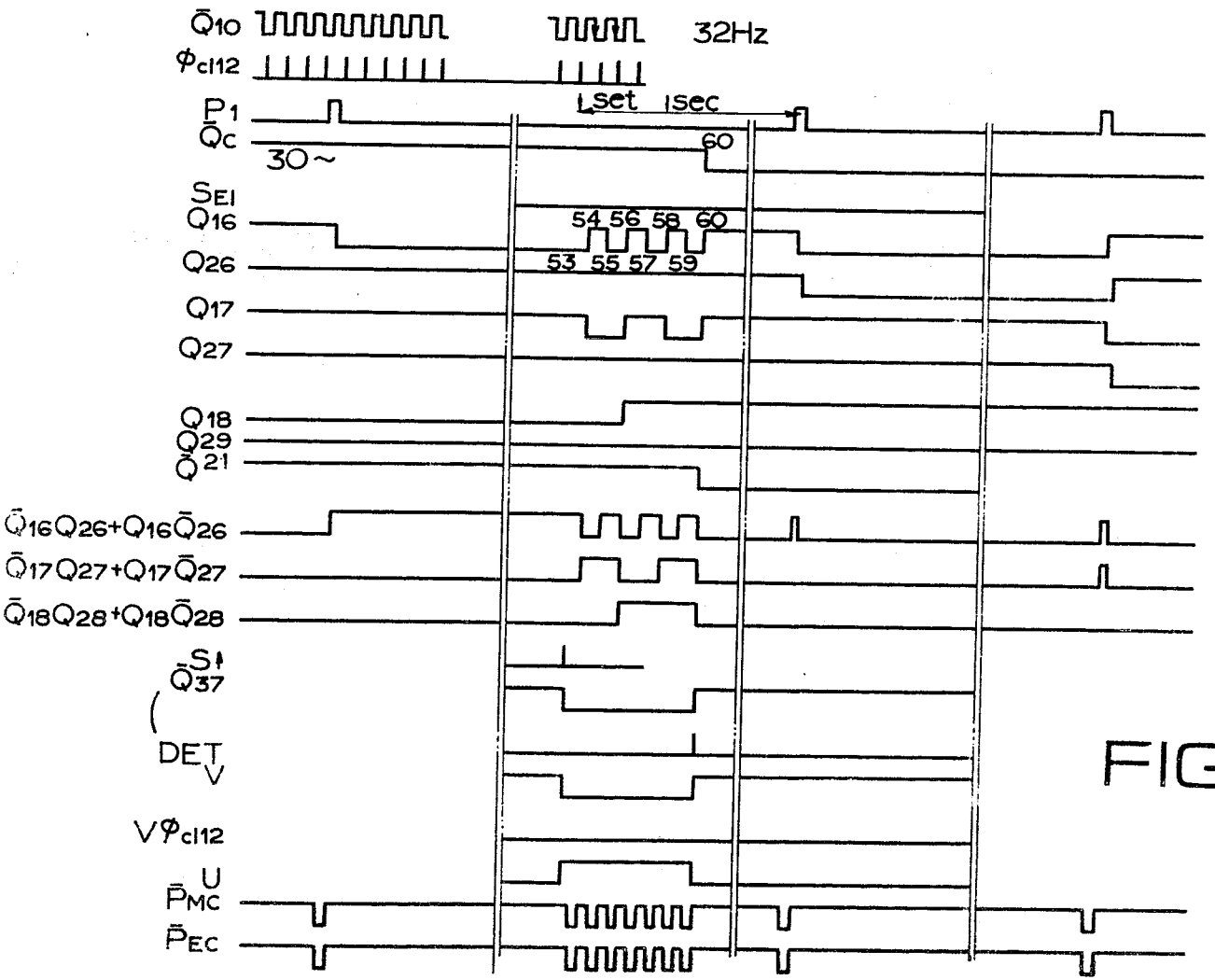
Figure 7:
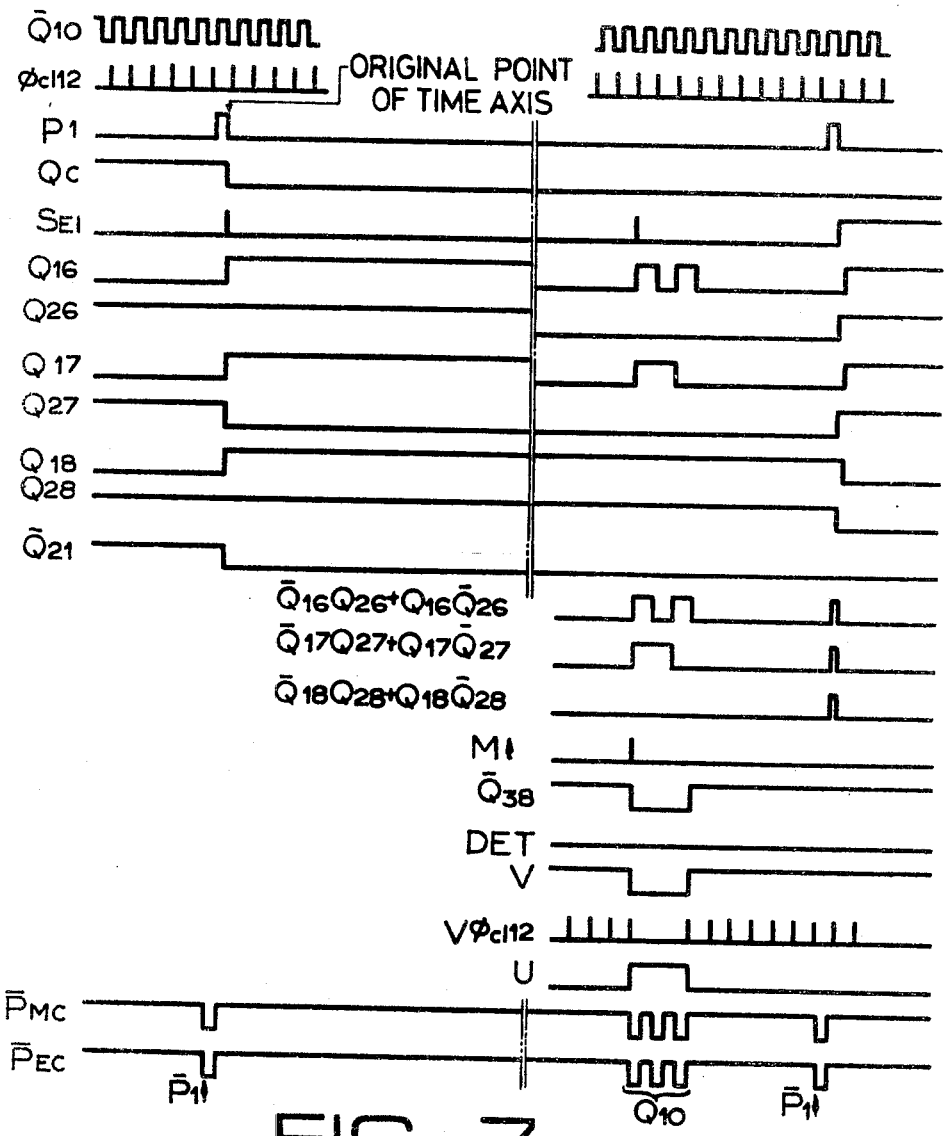
Figure 8:
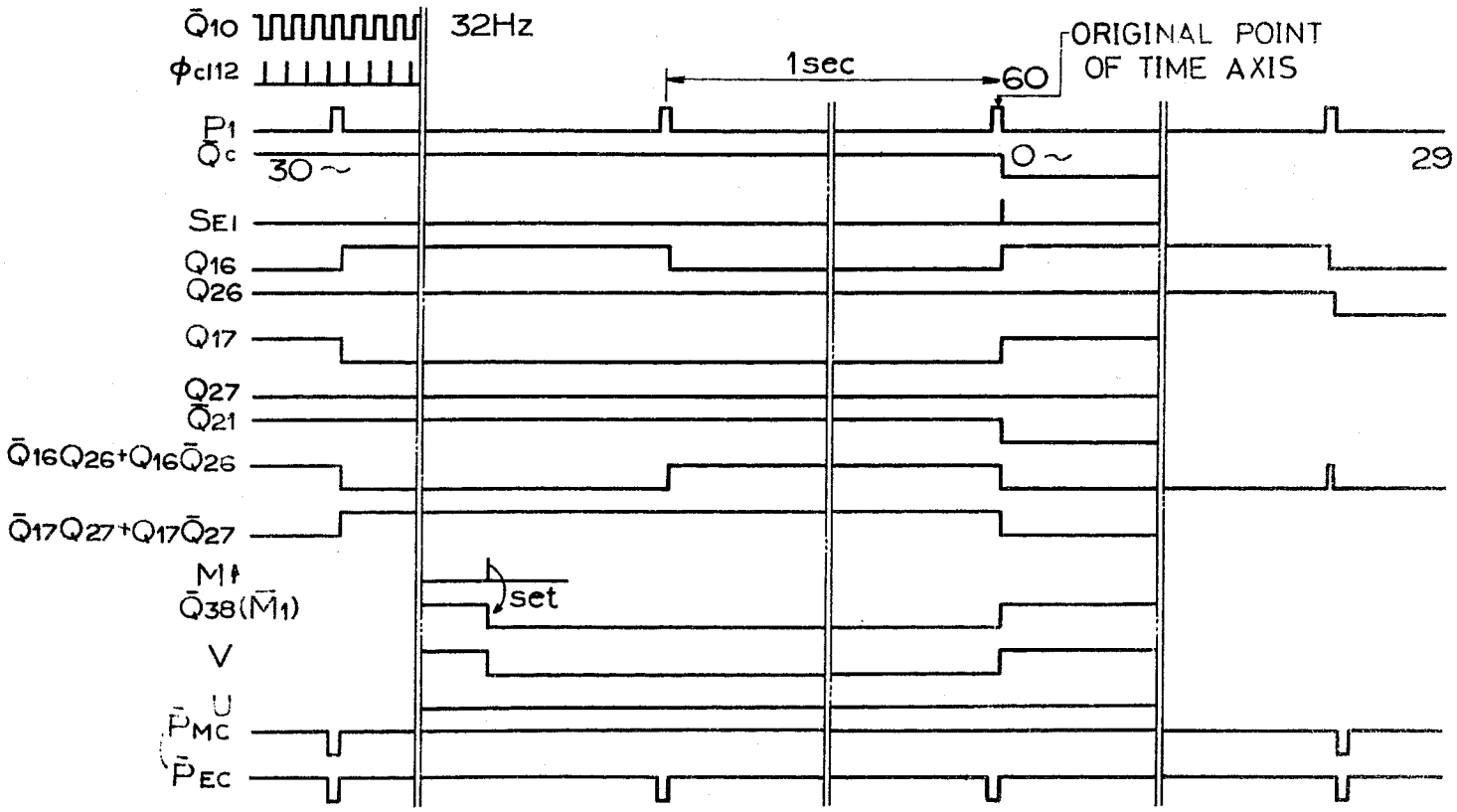

FIG. 3 diagrammatically illustrates the essential constitutional elements of the electronic timepiece shown in FIG. 1 in greater detail. Terminals $J_{12}$, $J_6$, $J_3$ and $J_{15}$ of the frequency regulation means 13 are adapted to supply signals required in the case of adjusting the frequency dividing ratio of the frequency division circuit 12 and are not used after the initial adjustment has been completed.

As shown in FIG. 3, the reference signal generation source 11 comprises a crystal oscillator 53 connected across terminals 51 and 52, a coupling condenser Cc inserted between the terminal 51 and an inverter 54, and a resistor $R_N$ having a high resistance value (for example, 30 MΩ) and connected across output and input terminals of the inverter 54. Reference numerals 55 and 56 designate MOS transistors adapted to operate as current limiters for supplying a given operating current to the inverter 54, respectively. The above mentioned various elements exclusive of the crystal oscillator 53 are incorporated into a single C/MOS integrated circuit.

The reference signal generation source 11 constructed as above described is capable of significantly reducing bias change subjected to the inverter 54 by the presence of the high resistor $R_N$ irrespective of a considerable change of temperature, and as a result, it becomes difficult to stop oscillations due to absorption of moisture. In addition, the stray capacity produced by the presence of the coupling condenser *Cc* operates as a condenser adapted to oscillate the crystal oscillator.

The terminal R is connected to the negative side Vss of the reference signal generation source 11 under the usual release condition and is connected to the substrate of the timepiece (the positive side $V_{DD}$ of the reference signal generation source 11) only when the second hand is stopped.

The terminal $S_o$ is connected to a winding crown switch and is connected to the positive side $V_{DD}$ of the reference signal generation source 11 only when it is desired to effect the zero second set so that the zero second set is not effected when the timepiece is stopped by means of the terminal R. That is, the zero second setting is effected by the fast feed of the second hand or by the stop thereof.

The terminal $M_o$ is an input terminal for use in synchronism and is connected to the substrate at least one time under such condition that the second hand indicates 0 second. The terminal $M_o$ may be connected to the substrate every time the second hand indicates 0 second or may be connected to the substrate at the position of 0 second of the second hand one time only after the battery is manually set to the timepiece. This causes the relative relation between the second hand position of the timepiece and the second of the electrical time keep to be memorized to effect synchronization calculation. The fast feed and stop of the second hand cause the second hand position of the timepiece to synchronize with the second of the electrical time keep. In the synchronized condition, the second hand position of the timepiece coincides with the second of the electrical time keep.

The light emitting diode (LED) display part 19 is provided for the purpose of displaying that the timepiece becomes out of order and stopped in the case of effecting the 0 second set due to the stop of the 0 second set. The LED display part 19 is turned on and off in synchronism with the pulse of the time unit signal.

In addition, the LED output is used also as the input terminal and serves to couple the $S_o$ terminal with the LED terminal, thereby connecting the $S_o$ terminal to the substrate (the positive side $V_{DD}$ of the reference signal generation source 11) and hence setting the internal condition to 0 by means of the electric circuit. Here, 0 of the internal condition shall be understood to mean that the content of the electric time keep second is 0 and a phase determination means driven by a pulse motor (which corresponds to a flip-flop $FF_{24}$) is made even number second phase (which corresponds to 0 second of the second hand).

$Q_A$ and $Q_B$ are alternate pulse driving signals delivered from the pulse motor, respectively. The sign of the potential difference between the driving signals $Q_A$ and $Q_B$ is alternately changed every 1 second and the pulse width of these signals $Q_A$ and $Q_B$ is 1/64 second.

The frequency of the output signal delivered from the reference signal generation source 11 including the crystal oscillator 53 having a given resonance frequency (for example, $2^{15}$ Hz = 32768 Hz) is divided into 1 Hz by means of a frequency division circuit portion 12*A* consisting of flip-flops $FF_1$ to $FF_{10}$ and a frequency division circuit portion 12*b* consisting of resettable flip-flops $FF_{11}$ to $FF_{15}$. The outputs from these frequency division circuit portions 12*a*, 12*b* are used as the time reference signal.

The flip-flops $FF_1$ to $FF_{10}$ only serve to divide the input frequency, while the flip-flops $FF_{11}$ to $FF_{15}$ serve to correct the phase of the output by their resetting so as to make the time keep unit of the timepiece 16 millisecond (= 1/64 second) which corresponds to a period of the output from the flip-flop $FF_{10}$, that is, 64 Hz signal.

In the present embodiment, all of the flip-flops are of a type which can invert the output logical value in synchronism with the rising up of the input signal. As a result, between a row of output pulses from the flip-flops $FF_{10}$ is located a clock pulse $\phi cl_{12}$ composed of an output pulse $Q_{22}$ from the flip-flop $FF_{22}$ and an output pulse $Q_{10}$ from the flip-flop $FF_{10}$.

The clock pulse $\phi cl_{12}$ serves to prevent occurrence of the erroneous operation due to noises in the course of various calculation treaties. As the frequency divided outputs, there are 1 Hz output signal $P_1$ having 1/64 second width and 32 Hz output signal $P_{32}$ having 1/64 second width.

The output from the frequency division circuit 12 is fed back through the frequency dividing ratio control circuit 13*b* to the EXCLUSIVE-OR gate 13*c*.

An output signal $\overline{P}_{MC}$ from the kept time control circuit 24 is supplied to a flip-flop $FF_{24}$ by which the frequency of the output signal $\overline{P}_{MC}$ is divided into ½. The sign of the output signal $Q_{24}$ from the flip-flop $FF_{24}$ is alternately inverted every time the output signal $\overline{P}_{MC}$ from the kept time control circuit 24 is supplied to the flip-flop $FF_{24}$. As a result, the output signal $Q_{24}$ is synchronized with the motor driving phase and is used as a signal which corresponds to the motor phase. Thus, the output signal $Q_{24}$ from the flip-flop $FF_{24}$ is combined with an output signal $\overline{P}_{MC}$ from the kept time control signal 24 to form alternate pulse driving signals $Q_A$ and $Q_B$ of the pulse motor. That is, these pulse motor driving signals $Q_A$ and $Q_B$ are given by $$Q_A = Q_{24}.\overline{P}_{MC} + \overline{Q}_{24}.P_{MC}$$

$$Q_B = Q_{24}$$

The pulse motor is driven by the pulse motor driving signals $Q_A$ and $Q_B$. The gear train 15*c* directly connected to the pulse motor keeps the time on and after the second and the time is displayed by the hand 16*a*.

As described above, the timepiece according to the invention comprises the electrical time keep means 14. The output signal $\overline{P}_{EC}$ from the kept time control circuit 24 is supplied to the electrical time keep means 14 consisting of 6 stage flip-flops $FF_{16}$ to $FF_{21}$ to effect the time keep up to 60 seconds. It is usually possible to count up to 64 by means of six stage flip-flops. 60, 61, 62 and 63 are detected by a flip-flop $FF_{23}$ and 0 setting is effected by a NAND gate 28*a* whereby the count operation up to 60 is effected.

That is, both the mechanical time keep means 15 and the electrical time keep means 14 perform the time keep operation independently from each other by means of the output signal from the kept time control circuit 24. Particularly, the frequency division circuit portion 12*b* consisting of the flip-flops $FF_{11}$ to $FF_{15}$ is a counter directly connected to the frequency division circuit of the flip-flop $FF_{10}$, while the electrical time keep means 14 consisting of flip-flops $FF_{16}$ to $FF_{21}$ is a time keep means which is equal to the mechanical time keep means 15 and operates independently thereof. This is one of the features of the invention.

The content of the electrical time keep means 14 is momentarily read into the memory count circuit 25. The memory count circuit 25 is a memory element which prevents the electrical time keep means 14 from being lost its kept time in the case of temporarily effecting the control calculation and is used for the purpose of eventually memorizing the kept time or memorizing the time after correction has been effected.

The count content of the electrical time keep means 14 is designated by $EC_2$ and the memory count content of the memory count cuircuit 25 is designated by $EC_3$.

In the steady state, the count content is set to $EC_2 = EC_3$ when $EC_2 = 0$ to 29 seconds and the count content is set to $EC_3 = 0$ when $EC_2 = 30$ to 59 seconds.

The operation of the timepiece according to the invention will now be described with reference to the case in which the 0 second set signal is supplied as an input.

a. If the 0 second set signal is supplied as the input under the condition that $EC_2 = 1$ to 29 seconds, the timepiece gains by the count content $EC_2$ if compared with the standard timepiece being observed. The count content $EC_2$ is set to 0 second and then the 1 Hz signal is supplied to the electrical time keep means 14 while stopping the hand 16*a* of the mechanical time keep means 15 for the time $EC_2 = EC_3$. The hand 16*a* of the mechanical time keep means 15 is shifted to the steady state operation when the count content $EC_2$ of the electrical time keep means 14 becomes equal to the memory count content $EC_3$ of the memory count circuit 25.

b. When the 0 second set signal is supplied as the input under the condition that $EC_2 = 30$ to 59 seconds, the timepiece loses by a count content 60-$EC_3$ if compared with the standard timepiece being observed. In this case, the memory count content $EC_3$ is reset to 0 second and then the 32 Hz signal is fed to both the electrical time keep means 14 and the mechanical time keep means 15 to cause both the mechanical time keep means 15 and the electrical time keep means 14 to be fast fed. When the count content $EC_2$ becomes 0 and equal to the memory count content $EC_3$, the fast feed is stopped and the hand 16*a* of the mechanical time keep means 15 is shifted to the steady state operation.

The above described operation is capable of controlling gain and lose of the timepiece. This control operation is significant only when the kept time of the mechanical time keep means 15 coincides with the kept time of the electrical time keep means 14.

The measure of bringing the kept time (with respect to the second unit) of the mechanical time keep means 15 into coincidence with the kept time of the electrical time keep means 14 will hereinafter be called as "synchronism". Let the kept time of the mechanical time keep means 15 be $MC_1$, then the kept time $MC_1$ may be synchronized with the kept time of the electrical time keep means 14, that is, with the count content $EC_2$ of the electrical time keep means 14 by the following two steps.

i. The mechanical time keep means 15 is made coincident with the electrical time keep means 14 ($MC_1 \rightarrow EC_2$).

ii. The electrical time keep means 14 is made coincident with the mechanical time keep means 15 ($MC_1 \leftarrow EC_2$).

If the kept time $MC_1$ of the mechanical time keep means 15 includes an electromechanical time keep means which is unreliable in operation, it is preferable to adopt the first step (i). The above corresponds, for example, to the case in which the driving current is reduced for the purpose of making the consumed current extremely small so that the hand supporting force becomes small and hence there is a risk of the hand being disturbed by the exterior effect. In this case, the kept time $MC_1$ of the mechanical time keep means 15 may be synchronized with the count content $EC_2$ of the electrical time keep means 14 in the same manner as the calculation control effected when the 0 second set signal $S_o$ is supplied as the input.

In the present embodiment, the input terminal $M_o$ is used as an input terminal for synchronization. In the case of manual synchronization, $M_o$ signal may be supplied as an input when the second hand indicates 0 second. This causes the kept time $MC_1$ to be synchronized with the count content $EC_2$ of the electrical time keep means 14 unless the converter becomes erroneously operated.

Alternatively, a second hand gear may be provided with a cam and the $M_o$ signal may automatically be supplied as the input at 0 second once every 60 seconds.

In the case of effecting synchronization by the step (ii), $EC_2 \rightarrow 0_1$ and $Q_{24} \rightarrow 0$ may be effected at $MC_1$ $=0$.

The synchronization with the aid of the step (i) will now be described.

a. If the $M_o$ signal is supplied as an input at $EC_2=0$ to 29 seconds, the $M_o$ signal is supplied as the input when the hand indicates 0 second. In this case, the mechanical time keep means 15 is slower in operation than the electrical time keep means 14 by the value $EC_2$. Thus, the count content $EC_2$ is set to 0 second and then a fast feed signal of 32 Hz is fed to the electrical time keep means 14, thereby fast feeding both the mechanical time keep means 15 and the electrical time keep means 14. When $EC_2=EC_3$, the operation is brought back into the steady state operation.

b. If the $M_o$ signal is supplied as an input at $EC_2=30$ to 59 seconds, the mechanical time keep means 15 is put faster than the electrical time keep means 14 by the value of 60-$EC_2$. Thus, the memory count content $EC_3$ is reset to 0 second and the 1 Hz signal is fed to the electrical time keep means 14, thereby stopping the mechanical time keep means 15. When $EC_2=EC_3=0$, the stopping operation is released to bring back the operation into the steady state operation.

When both the $S_o$ signal and the $M_o$ signal are supplied as inputs, steps shorter than 30 seconds are fast fed by a 32 Hz signal so that the fast feeding operation is completed within 1 second. In order to make fast or slow in response to the correcting signal of the timepiece, it is necessary to correlate the time difference of the timepiece with the kept time thereof and to memorize these time difference and the kept time by means of suitable memory means. In addition, addition and substraction calculations are required to be effected without degrading the kept time.

The memory count circuit 25 and the $M_o$ input time gate characterizing the invention will now be described.

As the method of comparing the count content $EC_2$ of the electrical time keep means 14 with the kept time $MC_1$ of the mechanical time keep means 15, a method of detecting the condition of the kept time $MC_1$ at $EC_2=0$ and a method of detecting the count condition of the count content $EC_2$ at $MC_1=0$ are considered. In the former method, it is necessary to know the condition of the mechanical counter with respect to its sign and value at $EC_2=0$ under any condition of the kept time $MC_1$. At least, the mechanical amount of both the presence and absence of sign and difference is required to be measured. In practice, apart from the presence or absence of the mechanical deviation, the amount of deviation cannot simply be measured. In the above described step (ii), that is, in the case of setting the electrical time keep means 14 to the mechanical time keep means 15, if the count condition of the count content $EC_2$ and $MC_1=0$, that is, the kept time of the electrical time keep means 14 is memorized by certain means, one information input can determine the following synchronizing operation without calculating the deviation between $MC_1$ and $EC_2$.

In the above described former step (i), that is, in the case of setting the mechanical time keep means 15 to the electrical time keep means 14, the deviation and the sign of the kept time of the hand as the mechanical amount must be detected at any time, while in the latter step (ii), it is only necessary to obtain the electrical signal when the hand indicates 0 second. In the latter step (ii), let the value of $EC_2$ when $MC_1=0$ be known, then either one of the following operations is required in order to synchronize $MC_1$ with $EC_2$.

1. The result of correction effected by the calculation is memorized, and as a result, $MC_1$ or $EC_2$ is controlled until $MC_1=EC_2$.
2. The amount of correction is memorized and $MC_1$ or $EC_2$ is corrected to the amount of correction thus memorized.

In these operations, some memory means is required. The present embodiment makes use of the above operation (1) and the memory count circuit 25 is provided for memorizing the time. The memory count circuit 25 serves to effect its counting operation in response to the electrical time keep means 14 and memorize the corrected result of the count content (kept time) $EC_2$ of the electrical time keet means 14.

The above operation (2) is capable of memorizing the presence and absence of the amount of correction instead of the corrected result by means of only one flip-flop and hence effecting synchronization by means of a plurality of synchronizing signals.

The memory count content $EC_3$ of the memory count circuit 25 is normally coincident with the count content $EC_2$ of the electrical time keep means 14. But, when $EC_2=30$ to 59 seconds, $EC_3$ is given by $EC_3=0$. Because, $EC_2$ is corrected so that $EC_2$ always becomes 60 seconds in the case of $EC_2=30$ to 59 seconds. When $EC_2=0$ to 29 seconds, the correction is effected to the degree of the count content $EC_2$. If the correction is effected with respect to the lapse of time required for the correction, the count content $EC_2$ returns to its original value. As a result, the correcting signal causes the $EC_2$ value to be memorized at $EC_3$ and $EC_2$ itself becomes 0 second. The correcting speed and the control of the mechanical time keep means 15 and the electrical time keep means 14 for effecting $EC_2 \rightarrow EC_3$ become different according to the $S_o$ input (0 second set) and the $M_o$ input (synchronizing input). As a result, provision must be made of a mechanism for memorizing the $S_o$ input and the $M_o$ input with distinction made therebetween.

In the present embodiment, such mechanism corresponds to set preferential type flip-flops $FF_{37}$ and $FF_{38}$.

The output signal DET from the coincidence detection circuit 29 is a signal which can detect whether or not $EC_2$ is coincident with $EC_3$. The output signal DET causes the $S_o$ switch input control circuit 23S and the $M_o$ switch input control circuit 23M to be reset so as to bring these circuits back from the corrected condition or the synchronized condition to the steady state, respectively.

In addition, the signal $Qc$ is a signal which can detect whether or not the count content of the electrical time keep means 14 is 30 to 59 seconds and becomes a logical output 1 when $EC_2=30$ to 59 seconds and becomes a logical output 0 when $EC_2=0$ to 29 seconds.

A combination logic of the above described signal $Q_0$ on the one hand and the above described signal $Q_{37}$ or $Q_{38}$ on the other hand selectively causes both the electrical time keep means 14 and the mechanical time keep means 15 to stop their operations or to fast feed them or to effect their 1 Hz feeding operations.

The above described embodiment ensures both the synchronization and the 0 second set. But, converging operation at the initial condition must be taken into consideration. That is, the $M_o$ input and the $S_o$ input under such condition that $MC_1$ is not coincided with $EC_2$ must be taken into consideration.

For example, if $EC_2 = 28$ seconds when $MC_1 = 0$, synchronization is effected when $MC_1 = 28$ and $EC_2 = 28$. If the $S_o$ signal is supplied as the input for $EC_2 = 29$ seconds when $MC_1 = 1$, the second hand is stopped for 29 seconds when $MC_1 = 1$. As a result, the kept time $MC_1$ of the mechanical time keep means 15 initially slows by 28 seconds and then becomes slow by further 29 seconds. The kept time $MC_1$ begins to move and arrives at $MC_1 = 60$ seconds at which time $EC_2 = 28$ seconds causes the second hand of the kept time $MC_1$ to fast feed for 28 seconds, thereby rendering $MC_1 = MC_2 = 28$ seconds. As a result, in the initial condition it is preferable to await until the $M_o$ signal is supplied as an input without supplying the $S_o$ signal as an input. If the switch for the $M_o$ signal includes noises, these noises always make the kept time $EC_2$ of the electrical time keep means 14 out of synchronism with the kept time $MC_1$ of the mechanical time keep means 15. In order to obviate such noises, provision is made of the noise preventive circuit 32 consisting of flip-flops $FF_{33}$ and $FF_{36}$ so as to constitute a timer circuit which can make the correction control mechanism insensitive for 16 to 24 seconds after the $M_o$ signal has been supplied as the input. The absence of the noise preventive circuit 32 prevents the hand of the timepiece from being brought into the correct time and prohibits the supply of the $S_o$ signal as the input.

The $S_o$ signal input is supplied to the pulse shape circuit 22S consisting of flip-flops $FF_{31}$, $FF_{34}$ and a NOR gate 22*a* to produce a signal which is synchronized with the clock pulse $\phi cl_{12}$ and which can set the $S_o$ switch input control circuit 23S to a differential signal S synchronized with the front edge of the $S_o$ signal input.

Similarly, if the $M_o$ signal is supplied as the input, the $M_o$ signal input is converted into a signal which can persists for 16 to 24 seconds by means of the noise preventive circuit 32. This signal is then supplied to the pulse shape circuit 22M consisting of flip-flops $FF_{32}$, $FF_{35}$ and a NOR gate 22*b* to produce a signal which is synchronized with the clock pulse $\phi cl_{12}$ and which can set the $M_o$ switch input control circuit 23M to a differential signal M↑. As described above, the noise preventive circuit 32 serves to widen the width of the $M_o$ signal and the output signal from the noise preventive circuit 32 has a long trailing edge which does not give an influence upon the timing of the differentially rising signal formed by the front edge of the output signal from the noise preventive circuit 32.

As a result, control signals U, V are given by output signals $Q_{37}$, $Q_{38}$ from the flip-flops $FF_{37}$, $FF_{38}$ and by the output singal Qc from the count content discrimination circuit 26.

That is, $$Q_{37} = \overline{S_1}$$
$$Q_{38} = \overline{M_1}$$
$$U = S_1.\overline{Qc} + M_1.\overline{Qc}$$
$$V = \overline{S_1}.\overline{R}.\overline{M_1}$$

The control signal U is a $S_o$ signal input of 0 to 29 seconds and a $M_o$ signal input of 30 to 59 seconds, that is, a signal for fast feeding the kept time $MC_1$ of the mechanical time keep means 15. The control signal U also serves to fast feed the kept time $EC_2$ of the electrical time keep means 14.

As a result, the logical value $U = 0$ effects 1 Hz feed of the kept time $EC_2$.

The control signal V is a signal for effecting 1 Hz feed of the kept time $MC_1$ of the mechanical time keep means 15. At the logical value $V = 1$, a clock pulse for reading the kept time $EC_2$ of the electrical time keep means 14 into the memory count content $EC_3$ of the memory count circuit 25 is formed.

Let a signal for feeding the kept time $MC_1$ be $P_{MC}$, a signal for feeding the kept time $MC_2$ be $P_{EC}$, 1 Hz signal be $P_1$ and 32 Hz signal be $P_{32}$, then $P_{MC}$ and $P_{EC}$ are given by $$P_{MC} = P_1.V + P_{32}.U$$
$$P_{EC} = P_1.\overline{U} + P_{32}.U$$

If $EC_3 = EC_2$ is detected, the DET signal serves to reset the $S_o$ switch input control circuit 23S and the $M_o$ switch input control circuit 23M, thereby completing the correcting operation or the synchronizing operation.

In the circuit shown in FIG. 3, symbols $Q_1 \ldots Q_{38}$ designate output signals from the flip-flops $FF_1 \ldots FF_{38}$, respectively, $P_1$ shows 1 Hz signal, $P_{32}$ illustrates 32 Hz signal, $\phi cl_{12}$ deisgnates the clock pulse signal, $SE_1$, $SE_2$ are output signals from the set instruction circuit 28, respectively, R illustrates a reset signal, S shows a set signal, U, V are signals for controlling the transmission of 1 Hz signal or 32 Hz signal to the mechanical time keep means 15 and the electrical time keep means 14, respectively, $\overline{P}_{MC}$ is the drive control signal of the mechanical time keep means 15, $\overline{P}_{EC}$ designates the drive control signal of the electrical time keep means 14, $Q_2$ is the output signal from the count content discrimination circuit 26 of the electrical control device 18, S↑, M↑ illustrate the output signals from the pulse shape circuits 22S, 22M, respectively, and $\overline{M}_1$ designates the output signal from the $M_o$ switch input control circuit 23M. Time charts of these signals are shown in FIGS. 4 to 8, respectively.

The above described embodiment according to the invention makes it possible to correct and synchronize at least slow time within 1 second by one operation of one calculating mechanism without producing any oscillation in the control system. But, provision must be made of an electrical time keep memory mechanism. In addition, the above embodiment makes use of one signal $MC_1 = 0$ from the mechanical time keep means 15 for one time only. This signal may also continuously be used.

Figure 9:
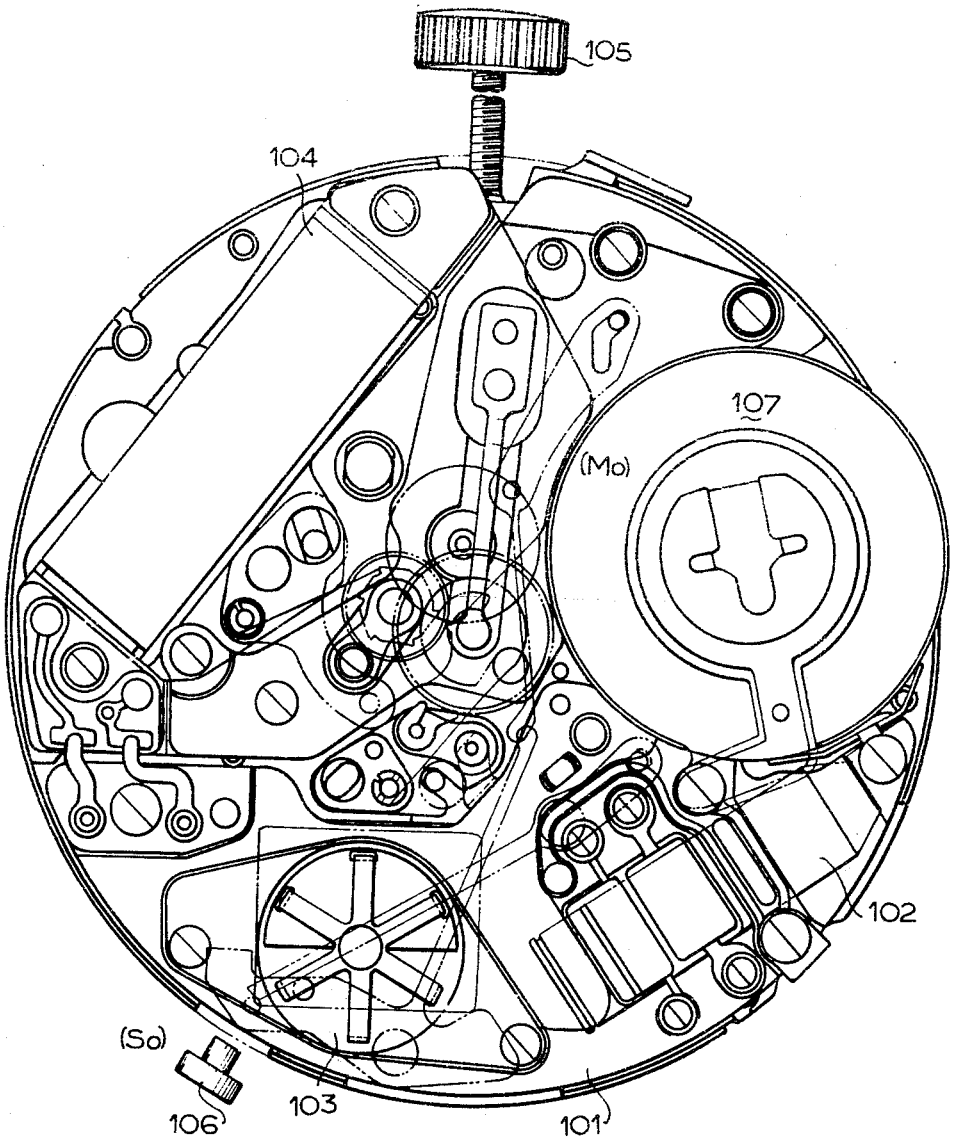
FIG. 9 is a plan view of the electronic timepiece shown in FIG 1, showing concrete arrangement of the various elements.

In FIG. 9 are shown concrete arrangement of main elements of an electronic wrist watch according to the invention. Reference numeral 101 designates a substrate, 102 a crystal oscillator, 103 a trimmer condenser, 104 a pulse motor, 105 a winding crown which is capable of not only operating a R switch but also correcting times, 106 a push button for a $S_o$ switch, and 107 a battery. The other elements are not described for ease of illustration, but the practical arrangement of these elements will be understood by those skilled in the art.

In the electronic timepiece according to the invention, if the oscillation frequency is maintained at an accuracy which is higher than a certain level, any reference signal generation source may be used irrespective of the form and kind thereof. But, as an oscillator having a most stable frequency under the present technical level, use may be made of a crystal oscillator including various forms of crystal oscillating elements. Particularly, a combination of such crystal oscillator and an inverter consisting of a pair of complementally connected MOS field effect transistors is suitable for a wrist watch which is required to be small in space and consumed electric power. For this kind of oscillator, it is desirous to provide a protective circuit for preventing the MOS field effect transistors from being broken.

Figure 10:
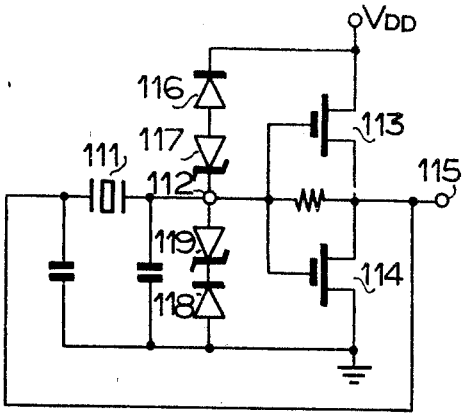
FIG. 10 is an electric circuit diagram of the crystal oscillator suitable for use in the electronic timepiece according to the invention.

In FIG. 10 is shown an oscillation circuit including the above described protective circuit. In the oscillation circuit shown in FIG. 10, the detecting voltage of the crystal oscillator 111 is supplied from an input terminal 112 to an inverter consisting of a pair of MOS field effect transistors 113 and 114 which amplify the detecting voltage and the output which is delivered from an output terminal 115.

The protective circuit shown in FIG. 10 includes a diode 116 and a zener diode 117 connected between the input terminal 112 and an electric source $V_{DD}$ and a diode 118 and a zener diode 119 connected between the input terminal 112 and the ground.

If a positive high voltage is applied from the input terminal 112 to the protective circuit, the protective circuit is biased by a voltage higher than $V_{DD} + V_F + V_{ZD}$ where $V_{ZD}$ is the zener voltage. Similarly, if a negative high voltage is applied from the input terminal 112 to the protective circuit, the protective circuit is biased by a voltage lower than $-(V_F + V_{ZD})$.

Figure 11:
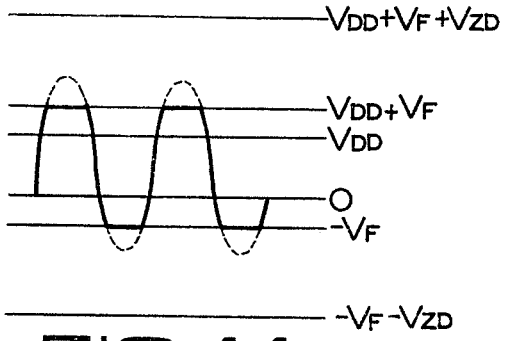
FIG. 11 is a graph showing the output wave form of the crystal oscillator shown in FIG. 10.

In FIG. 11 is shown an input voltage wave applied from the crystal oscillator 111 to the input terminal 112. If the zener diodes 117 and 119 are absent, upper and lower levels of the input voltage wave are limited as shown by dotted lines. On the contrary, the crystal oscillation circuit including the protective circuit according to the invention is not subjected to such level limitation. The output voltage from the crystal oscillater 111 has its level from $V_{DD} + V_F + V_{ZD}$ to $-V_F - V_{ZD}$ and is supplied to the input terminal 112.

In a CMOS integrated circuit adapted to be operated by an electric source voltage on the order of 1.5V which is applicable to electronic timepiece, the impurity concentration used in designing the integrated circuit causes $V_{ZD} \doteqdot 10V$ so that the biased voltage becomes higher than substantially 12V and lower than −10.5V, that is, the input voltage is not biased within a range of ± 10V. As a result, there is no risk of a CMOS gate oxide film having a thickness on the order of 1000 A being broken by the voltage on the order of 10V. Thus, the oscillation circuit including the protective circuit shown in FIG. 10 can sufficiently protect the CMOS integrated circuit and maintain its effective property. In addition, the crystal oscillation circuit has such property that the voltage of the crystal oscillator 111 applied to the input terminal 112 does not exceed ± 10V. As a result, the crystal oscillator 111 has no energy loss and the load impedance thereof is not changed. In addition, a voltage higher than the prior art is applied to the input terminal of the CMOS inverter so that its output current $I_{DS}$ causes $Gm$ of the CMOS inverter to make large. Thus, the output impedance with respect to the crystal oscillater 111 becomes decreased, thereby improving the rise in the oscillation property and the stability of the electronic circuit.

Figure 12:
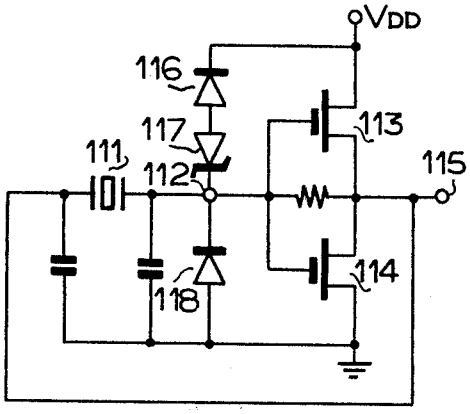
FIGS. 12 to 14 are electric circuit diagrams of modified crystal oscillators suitable for use in the electronic timepiece according to the invention.

In FIG. 12 is shown a modified oscillation circuit in which the zener diode 119 shown in FIG. 10 is omitted from the negative potential side and the measure described above with reference to FIG. 10 is applied to the positive potential side only.

Figure 13:
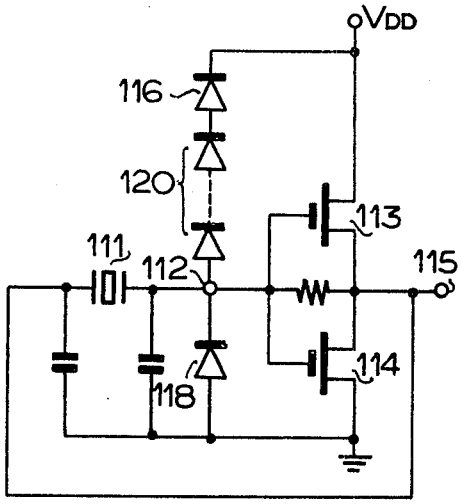

In FIG. 13 is shown another modified oscillator circuit in which the zener diode 117 shown in FIG. 12 is replaced by a plurality of diodes 120.

Figure 14:
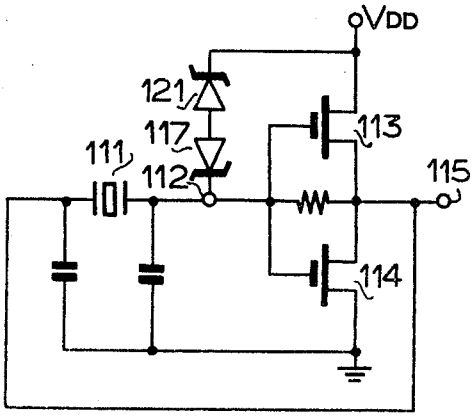

In FIG. 14 is shown a further modified oscillation circuit in which all of the diodes and zener diodes of the protective circuit shown in FIG. 10 are replaced by the zener diodes 117 and 121.

Figures 15, 16, 17, 18:
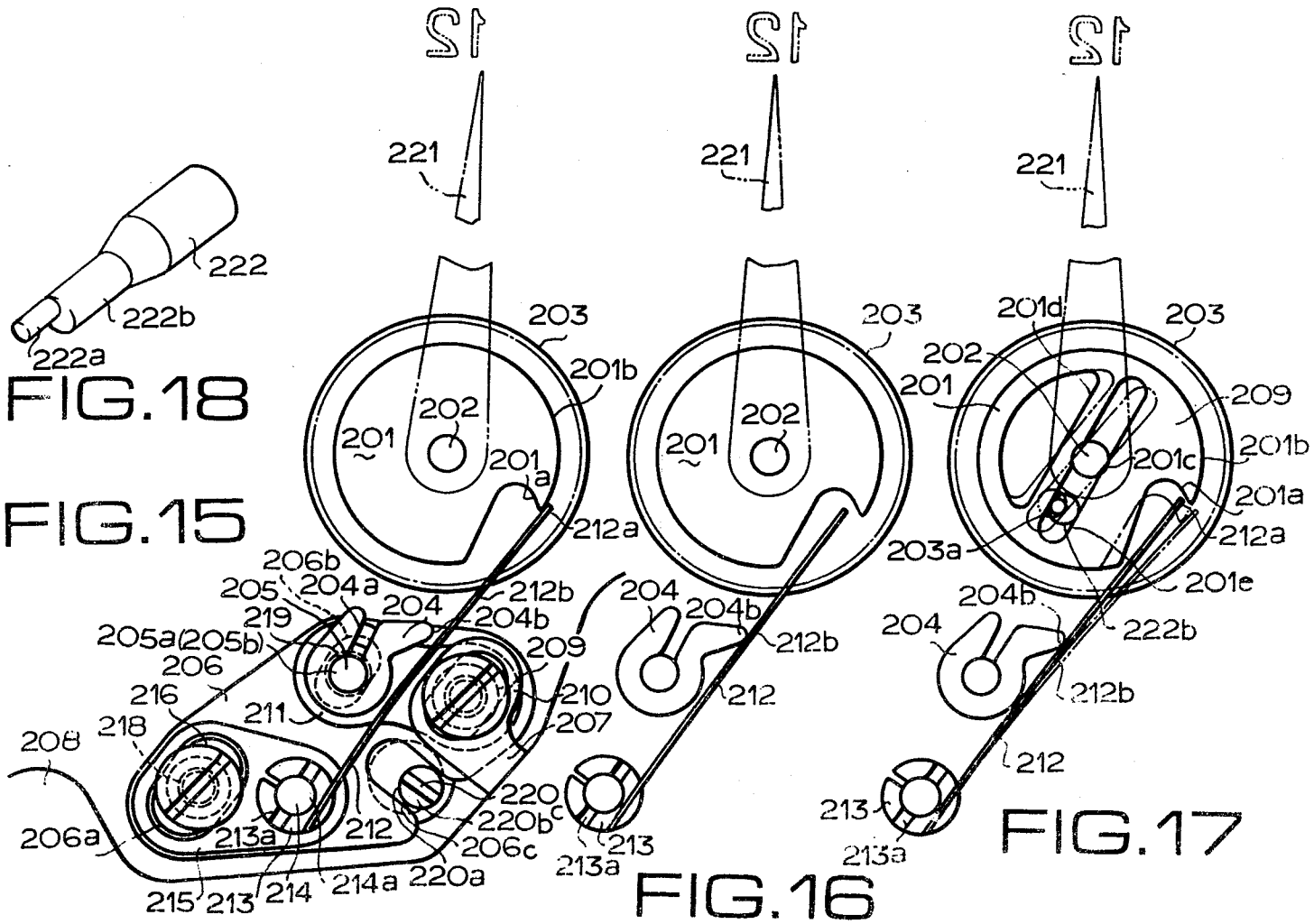
FIG. 15 is a plan view of the construction of a switch suitable for use in the electronic timepiece according to the invention, viewed from the rear side of the timepiece.
FIG. 16 is a plan view of the switch shown in FIG. 15, showing its different condition.
FIG. 17 is a plan view of a modified switch showing its construction.
FIG. 18 is a perspective view of a tool for effecting the timing adjustment of the switch shown in FIG. 17.

In FIGS. 15 and 16 is shown a preferred embodiment of the $M_o$ switch which can detect the kept time of the mechanical time keep means 15 at a given period. In FIGS. 15 and 16, reference numeral 201 designates a circular cam rotatably mounted on a second hand shaft 202 provided with a second hand gear 203. 204 shows a contact provided with a notch **204*a* and resiliently fitted about the upper part 205*a* of a contact shaft 205 whose lower part 205*b* is embedded into a supporting plate 206 formed by insulating material. 207 designates a lead plate I connected to a circuit incorporated into a circuit base 208 and secured to the upper part of a lead terminal 209 by means of screws 210 of the lead plate I (207), the lead plate 207 being secured to the supporting plate 206. 211 is a lead plate II press fitted about the contact shaft 205 and the lead terminal 209. 212 shows a contact spring having one end secured to a contact spring ring 213 which is resiliently fitted around the upper part 214*a* of the contact spring shaft 214 secured to the supporting plate 206. 215 designates a lead plate III press fitted around the contact spring shaft 214 and arranged on the upper surface of the supporting plate 206. 216 is a set screw for the supporting plate 206 which is secured to the substrate (not shown) by means of screws. A tube 218 is secured to the substrate and adapted to guide an elongate hole 206*a* provided for the supporting plate 206. 219 designates a guide pin for the supporting plate 206 and secured to the substrate and adapted to guide an elongate blind hole 206*b* provided for the lower surface of the supporting plate 206. 220 illustrates a micro-adjusting eccentric shaft. The center of a shaft 220*a* is eccentric with respect to the center of an axis 206*b*. The shaft 220*a* is loosely engaged with the substrate and the shaft 220*b* is adapted to guide an elongate hole 206*c* of the supporting plate 206**.

The above described construction makes it possible to connect the contact spring 212 through the contact spring ring 213, contact spring shaft 214, lead plate III (215), supporting plate set screw 216 and tube 218 to the grounded substrate. The contact 204 is connected through the contact shaft 205, lead plate II (211), lead terminal 209, lead plate I set screw 210 to the lead plate I (207) and connected to the display time checking terminal arranged on the circuit base 208.

In FIG. 17 is shown a modified embodiment of the construction shown in FIGS. 15 and 16. In the present embodiment, a center hole **201*c*, of the circular cam 201 is resiliently fitted around the second hand shaft 202 by means of the spring property of an arm 201*d* and the second hand gear 203 is provided with a small hole 203*a* arranged in a hole 201*e*** having a larger diameter.

In FIG. 18 is shown an adjusting jig 222 having a reduced eccentric shaft **222*a* adapted to be engaged with the small hole 203*a* and an intermediate shaft 222*b* adapted to be engaged with the larger diameter hole 201*e***.

The outer periphery **201*b* of the circular cam 201 secured to the second hand shaft 202 is slidably engaged with the free end 212*a* of the contact spring 212 under a comparatively weak spring pressure. When the free end 212*a* of the contact spring 215 becomes dropped into the notch 201*a* of the circular cam 201** as shown in FIG. 16, one of the front ends 204*b* of the contact 204 is brought into contact with the side surface 212*b* of the contact spring 212 to turn on the switch. At this time, it is assumed that a second hand 221 secured to the second hand shaft 202 indicates 12 hours. As a result, the input signal supplied into the switch can detect a time error between the time indicated by the mechanical counter (second hand) and the time indicated by the electrical counter incorporated into the circuit. Thus, the second hand is made stopped or fast fed for a desired time by means of a control circuit, and as a result, the second hand can be corrected such that it coincides with the time kept by the electrical counter.

It is rather difficult to precisely mount the second hand 221 on the second hand shaft 202 in a manner such that the second hand 221 indicates 12 hours as soon as the switch is turned on. As a result, in order to minutely adjust that timing at which the switch is turned on after the second hand 221 has been mounted on the second hand shaft 202, that is, to minutely adjust the position relation between the free end 212*a* of the contact spring 212 at the time when it is dropped into the notch 201*a* of the switch cam 201 on the one hand and the second hand 221 on the other hand, in other words, in order to effect the switching operation at the time intermediate between 59 seconds and 0 second of the gear train position, a minutely adjusting eccentric shaft 220*b* shown in FIG. 15 is rotated by a tool such as a driver and the like which is inserted into a groove 220*c*. Thus, the supporting plate 206 is supported by the guide pin 219 and tube 218 secured to the substrate and moved along the elongate holes 206*b*; 206*a* of the supporting plate 206 such that the free end 212*a* of the contact spring 212 is displaced in a direction which is tangent to the switch cam 201. The spring pressure for urging the free end 212*a* of the contact spring 212 against the outer periphery 201*b* of the switch cam 201 and the amount of displacement of the free end 212*a* of the contact spring 212 which is produced when the free end 212*a* is dropped into the notch 201*a* of the switch cam 201 may be adjusted by means of a jig and the like by inserting it into a groove 213*a* formed in the upper surface of the contact spring ring 213. A gap formed between one of the two free ends 204*b* of the contact 204 and the side surface 212*b* of the contact spring 212 and the contact pressure of the former urged against the latter may suitably be adjusted with the aid of a driver and the like by inserting it into a notch 204*a* of the contact 204 and by rotating the contact 204. Alternatively, the above described timing at which the switch is turned on may be adjusted by changing the position of the notch 201*a* of the circular cam 201 with respect to the second hand gear 203 while making the position of the free end 212*a* of the contact spring 212 stationary. For this purpose, the reduced shaft 222*a* of the adjusting jig 222 shown in FIG. 18 is inserted into the small hole 203*a* of the second hand gear 203 secured to the second hand shaft 202 and the intermediate shaft 222*b* is inserted into the larger hole 201*e*. Then, the adjusting jig 222 is rotated to change the position of the notch 201*a* of the circular cam 201 with respect to the second hand gear 203.

The contact spring 212 may be insulated from the substrate and connected to the circuit checking terminal.

The circular cam 201 may be of a circular cam provided with a projection in place of the notch 201*a* and the free end 212*a* of the contact spring 212 may be arranged near the outer periphery of the circular cam 201 and may be made periodically contact with the projection, the contact spring 212 being connected through the gear train to the grounded substrate. Alternatively, the circular cam 201 may be combined with a separately provided contact. In place of the circular cam, use may preferably be made of a metal contact terminal whose flat surface is embedded into an insulating disc.

Figure 19:
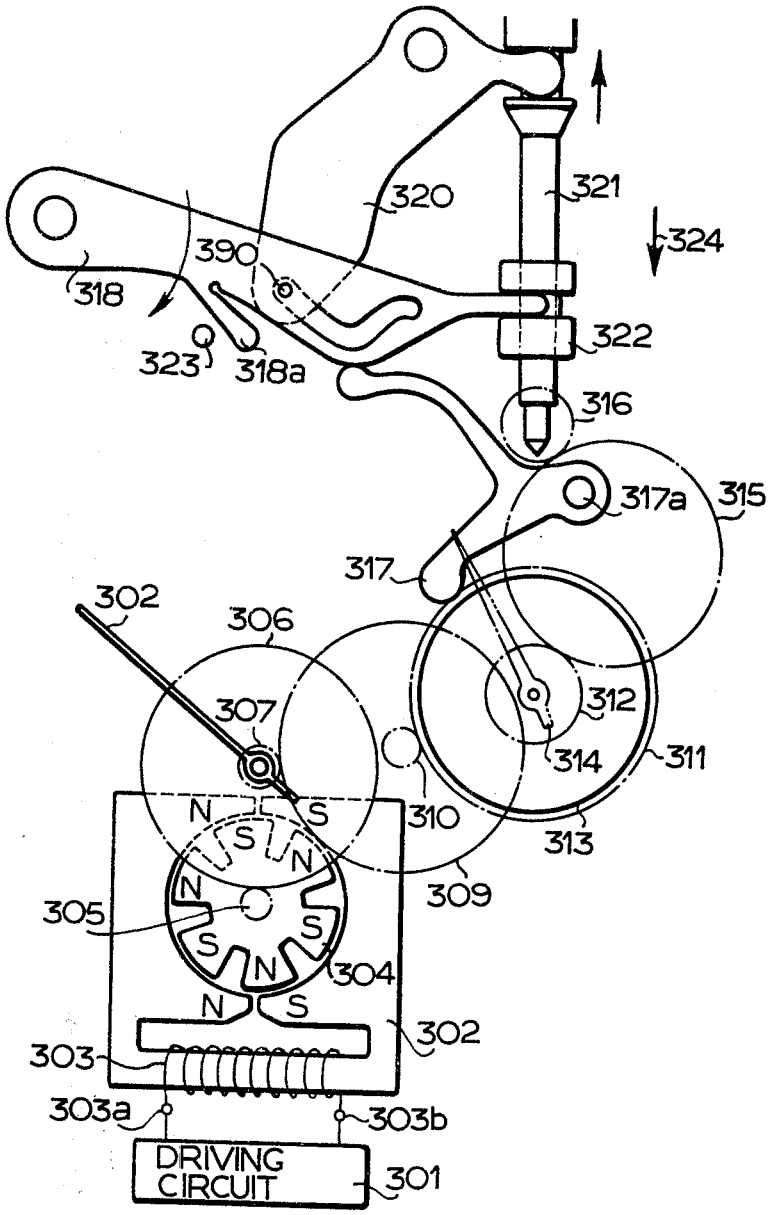
FIG. 19 is a diagrammatic plan view of a mechanism for temporarily stopping hands and applicable to the electronic timepiece according to the invention.

In FIG. 19 is shown a mechanism for temporarily stopping the hand of the electronic timepiece according to the invention. In FIG. 19, reference numeral 301 designates a driving circuit, 302 a yoke made of magnetic materisl, 303*a*, 303*b* coil terminals, 304 a rotor and 305 a pinion made integral with the rotor 304 and threadedly engaged with a fourth gear 306.

307 shows a fourth wheel pinion made integral with the fourth gear 306 to form a fourth wheel. The fourth wheel is provided at its front end with a second hand 308 fitted to the fourth wheel pinion 307. 309 shows a third gear which is made integral with a third wheel pinion 310 to form the third gear and 311 illustrates a second wheel.

312 is a cannon pinion frictionally fitted onto a second wheel 311 and provided at its front end with a minute hand 314 fitted thereto.

313 designates a brake plate made integral with the second wheel 311.

315 is a minute wheel, 316 a setting wheel, 317 a brake member rotatably mounted about a brake pin 317*a* secured to the substrate (not shown).

318 shows a clutch lever, 319 a setting lever pin made integral with a setting lever 320, 321 a winding stem and 322 a clutch wheel.

In FIG. 19, the second wheel 311 for supporting the minute hand 314 and the fourth gear 306 for supporting the second hand 308 are mounted on separate axes, but in general these wheel and gear may coaxially be mounted.

The clutch lever 318 is provided with an elongate and downwardly extended contact portion 318*a* made integral therewith. The contact portion 318*a* makes contact with a terminal 323 projected from the substrate (not shown) when the clutch lever 318 is rotated in a direction shown by an arrow in FIG. 19. The contact portion 318*a* and the terminal 323 constitute the above described R switch for temporarily stopping the hand.

If the winding stem 321 is pulled in a direction shown by an arrow in FIG. 19, the setting lever 320 engaged with the winding stem 321 is rotated in a counter clockwise direction and the clutch lever 318 engaged with the pin 319 is rotated in a clockwise direction, thereby making the contact portion 318*a* contact with the terminal 323. As a result, the above described electronic operation occurs to interrupt the driving pulse supplied to the pulse motor 302. The clutch lever 318 in the course of rotation in the clockwise direction is urged against the brake member 317 to rotate it about the brake pin 317*a* in a counter clockwise direction. As a result, the brake member 317 is urged against the brake plate 313 made integral with the second wheel 311, thereby stopping the second wheel 311 and firmly holding it in its stop condition.

In this case, the clutch lever 318 causes the clutch wheel 322 to move in a direction shown by an arrow 324 and engage with the setting wheel 316. In the case of setting the hand, the cannon pinion 312 is rotated while slipping with the second wheel 311 through the winding stem 321, clutch wheel 322, setting wheel 316 and minute wheel 315.

The rotation is not transmitted to the third wheel 309 and fourth wheel 306 which are located after the second wheel 311 as seen from the hand setting gear train so that there is no risk of back lash being occurred from the second wheel 311 to the rotor pinion. As a result, any displacement is not occurred between the second hand and the minute hand against one's will after the hand has been set.

The brake plate 313 is not provided with gear teach, but is of circular in form so that the rotation of the brake plate 313 is limited to a least possible extent, whereby the rotor 304 is not rotated. The contact surface between the brake plate 313 and the brake member 317 may be provided with longitudinal ridges or may be made of a material having a large frictional coefficient for the purpose of increasing the holding force.

The above described hand control mechanism is capable of setting the hand to, for example, correct minute and correct second as desired irrespective of the direction of rotation of the hand in the case of setting the hand. In addition, the hand control mechanism causes no rotation of the rotor and hence does not disturb its proper magnetic coupling, and as a result, not only the pulse motor does not become out of order in polarity in the case of starting it, but also the conversion efficiency can be improved. Moreover, the above described parts constituting this hand control mechanism are simple in construction so that these parts may be arranged without requiring any alignment and are beneficial in their working.

Figure 20:
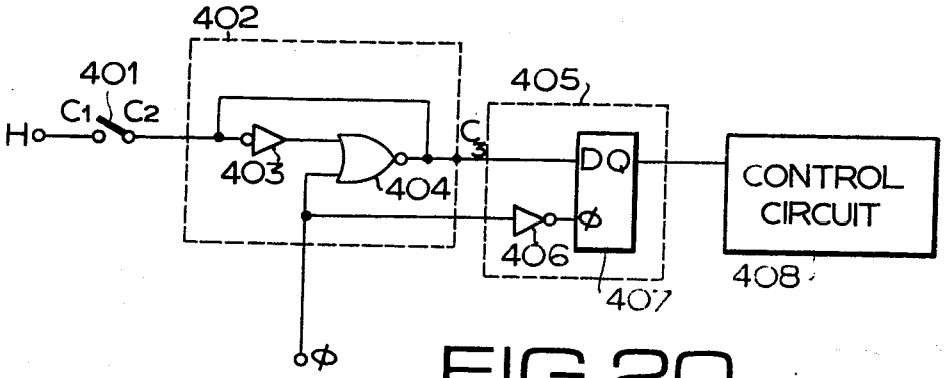
FIG. 20 is a block diagram showing a switch input circuit applicable to the electronic timepiece according to the invention.

In FIG. 20 is shown an input circuit adapted for use in the above described R switch, $S_o$ switch and $M_o$ switch and which is simple in construction and stable in operation.

In FIG. 20, reference numeral 401 designages a normally open switch which corresponds to the R switch, $S_o$ switch or $M_o$ switch and the contact $C_1$ of which is held at H level. 402 shows a holding circuit which can hold the switch 401 at its closed condition and which can be synchronized with a clock signal $\phi$ and released after the switch 401 has been changed into its open condition and which is composed of an inverter 403 and a NOR gate 404. 405 shows a synchronization setting circuit adapted to bring the output signal from the holding circuit 402 in synchronism with the clock pulse and read it and composed of an inverter 406 and a conventional D flip-flop 407 (hereinafter will be abbreviated as D-FF). 408 illustrates a control circuit which can effect a given operation upon receipt of the output from the D-FF 407.

The operation of the above input circuit applied to the $S_o$ switch for use in correcting the display time will now be described.

When the display is not corrected, the display correcting switch 401 is made open and the holding circuit 402 whose memory characteristic is given by a closed loop including the inverter 403 and the NOR gate 404 is released by the rising edge of the clock signal $\phi$. An output terminal $C_3$ of the holding circuit 402 is memorized and held at L level. The output signal from the output terminal $C_3$ is supplied to a data terminal D of the D-FF 407 and synchronized with a clock pulse $\overline{\phi}$ inverted by the inverter 406, that is, with the trailing edge of the clock signal $\phi$ and read in, thereby holding the output Q from the D-FF 407 at L level. As a result, the control circuit 408 is not set so that the display is not corrected.

In the case of correcting the display, the above described exteriorly operating member is operated to a position predetermined according to the display content to be corrected. As a result, the switch 401 which corresponds to the above described operated position is closed, thereby forcedly inverting the L level into the H level. Thus, the output terminal $C_3$ of the holding circuit 402 becomes H level and the reading is effected to the D-FF 407 by the timing of the trailing edge of edge of the clock signal $\phi$ which is the first after the output terminal $C_3$ has been inverted into the H level. As a result, the output signal of the H level is produced at the output terminal Q. Thus, the control circuit 408 is set to start the display correcting operation. The display correcting operation is continued while the switch 401 is closed.

Even though chattering is produced when the switch 401 is operated, the memory characteristic of the holding circuit 402 causes the H level of the output terminal $C_3$ to be kept in its stable state.

After the display correction has been completed, if the exteriorly operating member is operated, the switch 401 is restored to its open condition to release the holding circuit 402 from its forced holding condition. The memory characteristic of the holding circuit 402 causes the output terminal $C_3$ to be held at the H level. The holding circuit 402 is released by the timing of the rising edge of the clock singal $\phi$ which is the first after the switch 401 has been restored to its open condition, thereby inverting the output terminal $C_3$ into the L level. In addition, the D-FF 407 is inverted by the timing of the trailing edge of the clock signal $\phi$ which has released the holding circuit 402 and the output Q is restored to the L level to release the setting of the control circuit 408, thereby completing the display correcting operation.

If the switch 401 is closed to hold the holding circuit 402 at the H level and the clock pulse $\phi$ is supplied, a loss current flows through ON resistor of a C-MOS-transistor of the NOR gate 404 for a pulse width of the clock signal $\phi$. In order to reduce such loss current, it is preferable to make the ON resistor of the NOR gate 404 relatively high. In the present embodiment shown in FIG. 20, the ON resistor is made higher than 10 KΩ.

Figure 21:
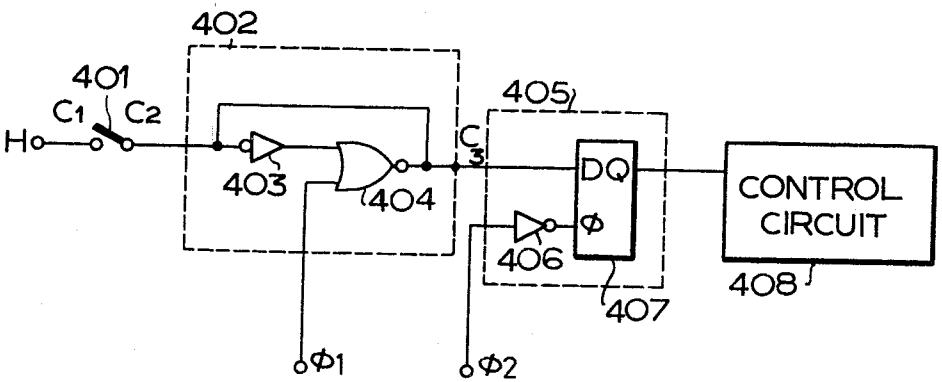
FIG. 21 is a block diagram showing a modified switch input circuit.

In FIG. 21 is shown a modified embodiment of the input circuit shown in FIG. 20, which can reduce the loss current.

The circuit shown in FIG. 21 is different from the circuit shown in FIG. 20 with respect to the fact that a clock signal $\phi_1$ for releasing the holding circuit 402 and a clock signal $\phi_2$ for reading the synchronization setting circuit 405 are supplied to respective circuits separately, and that the clock pulse $\phi_1$ is made a relatively low signal and the clock pulse $\phi_2$ is made a relatively high signal, whereby the loss current is reduced.

In FIG. 21, like parts as FIG. 20 are designated by like numerals.

As stated hereinbefore, the display correction circuit according to the invention is composed of a switch which is simple in construction and a C-MOS-transistor adapted to be easily incorporated into an integrated circuit and provides the important advantage that the display correction circuit according to the invention is easy in design, reliable in operation, and requires small number of constitutional elements.

In order to privide an ideal and complete electronic timepiece according to the invention, it would be necessary to push a second return to zero button as easy as possible for the purpose of pushing the second return to zero button immediately after hearing an announcement of time by a radio or television broadcasing. But, in order to make the time held by the timepiece precise, it is presumable that the initial time set error should be smaller than a given value which is small and guaranteed and that the time keep should be reliable in operation. From this point of view, the electronic timepiece according to the invention must be designed such that its reliability is established by taking probability of erroneous operations into consideration. As a result, an electric counter, for example, must be used under such condition that the highest reliability which is theoretically guaranteed can be obtained. Particularly, the circuit arrangement according to the invention is required to be of a C/MOS type integrated circuit which provides a material decrease in consumed current and which is high immunity from noise. In addition, the circuit must be provided with a condenser having a relatively large capacity and connected in parallel with the circuit such that the oscillation frequency dividing time keep mechanism maintains its normal operation for a duration which is longer than several tens seconds with substantially no driving force of a pulse motor of the integrated circuit even when the electrical connection with a battery is interrupted by the exterior mechanical disturbance under the used condition of the circuit. Moreover, the circuit is connected through a plurality of contact pieces to the battery and these contact pieces must be constructed such that these contact pieces are slidable along the battery, but are not separated therefrom even when these contact pieces are subjected to the exterior disturbance all of which are rorated in directions to and fro, left and right and up and down.

The switch mechanism for automatically synchronizing the mechanical time keep means with the electrical time keep means must carefully be designed in mechanism such that the exterior disturbance produces no erroneous signals. That is, provision must be made of a mechanical locking mechanism or a mechanical guard mechanism which can prevent the contact pieces from being bent so that there is no risk of the contacts being made with each other at those times which are not desired and that there is no risk of the contacts being separated from each other at those times which are not desired. For this purpose, use must be made of the above described insulating disc type synchronizing switch mechanism. The integrated circuit for use in the electronic timepiece according to the invention is provided with a noise preventive circuit and a timer mechanism so that it can effect the synchronization of time in a significantly reliable manner. There is no risk of the synchronization of time being degraded even when the timepiece is dropped or struck against objects or subjected to oscillation. In addition, even if any conversion miss is produced by the exterior mechanical disturbance subjected to the electronic timepiece at the most unstable instant when the rotor of the pulse motor changes its position, the electronic timepiece can be corrected to its normal state within one minute.

It is preferable to construct the second set switch so that it is projected and its spring is weak so as to easily set the second. But, the second return to zero signal input terminal must be provided with means for discriminating whether the second correcting operation is effected consciously by the user or effected accidentally.

The electronic timepiece according to the invention must be easy in handling and reliably keep the time and compatible therewith. For this purpose, the second return to zero button is made of a small type push button. The head of the push button is normally sunk into the timepiece casing and positioned in a grooved hole so as to be pushed and displaced by a user's nail, thereby consciously effecting the second correcting operation.

Alternatively, the winding crown and the push button may be arranged at diametrically opposite positions of the timepiece case and the second return to zero operation may consciously be effected when both the winding crown and the push button are pushed so as to discriminate the above operation to obtain the $S_o$ input. In addition, that surface at which the second hand engages with the second gear shaft is made non-circular in section so that the exterior disturbance causes no slidable engagement between the second hand and the second gear shaft.

The electronic timepiece according to the invention carefully constructed as above described is capable of positively operating "a moisture resisting crystal oscillator circuit, low impedance input terminal circuit, double noise immunity input circuit and timer input circuit" and reliably effecting "noise immunity of input signal, reliable operation by standardization of operation input signal obtained by differentiation after the wave has been shaped and reliable second return to zero operation by the closed loop control system" as a timepiece system comprising a synchronizing mechanism which is reliable and precise in operation with the aid of a memory mechanism. Thus, provision can be made of a crystal timepiece which is extremely reliable in operation and very easy in handling and which has never been attained.

The above described basic idea of the invention may be applied to construct a time keep setting mechanism of a highly precise timepiece. For example, the kept time may be determined by an average time which is remained in the case of omitting the uppermost and lowermost kept time of a plurality of parallel operated time keep means. In addition, provision may be made of one or plurality of standard time set signal receiver mechanisms to read out and memorize the standard time input signal as a relation between the kept time and the standard time per se. In this case, an average composite standard signal is obtained from that information which is remained in the case of omitting the uppermost and lowermost memorized informations.

When a standard time signal which is considered to be the most precise one and which is determined from a number of received informations of the transmitted standard signal, for example, two kinds of standard times which are discrete from each other with respect to that value which is considered to be theoretically precise with the aid of averaging treaties are received by a plurality of receiver mechanisms, the time of the electronic timepiece according to the invention may be set to that standard time signal which is decided by majority of the highly reliable standard times.

What is claimed is:

1. An electronic timepiece comprising:

a. a time unit signal generator including an oscillator for generating a frequency reference signal and means for forming from said frequency reference signal a time unit signal consisting of a pulse signal having a given frequency;

b. a mechanical time keep means for effecting a time keep operation in accordance with the time unit signal from said time unit signal generator to display a kept time;

c. an electrical time keep means for effecting the time keep operation independently of said mechanical time keep means in accordance with the time unit signal from said time unit signal generator;

d. a manually operable correction means for correcting a kept time of said electrical time keep means; and e. a synchronizing signal generation means for comparing respective kept times of said mechanical and electrical time keep means to bring the kept time of the mechanical time keep means into coincidence with the kept time of the electrical time keep means.

2. An electronic timepiece as claimed in claim 1 wherein said oscillator is a crystal oscillator including a crystal oscillation element, an inverter consisting of a field effect transistor whose input signal is a signal produced by oscillations of said crystal oscillator and a zener diode connected between an input terminal of said inverter and a direct current supply source and adapted to protect said field effect transistor.

3. An electronic timepiece as claimed in claim 1 wherein said oscillator is a crystal oscillator including a crystal oscillation element, an inverter whose input is a signal produced by oscillations of said crystal oscillation element, a coupling condenser connected between said crystal oscillation element and said inverter and a resistor connected between output and input terminals of said inverter.

4. An electronic timepiece as claimed in claim 1 wherein said mechanical time keep means comprises a pulse motor adapted to be operated in accordance with a pulse of said time unit signal, means for generating a synchronizing signal for a constant period given by rotation of a rotatory shaft of said pulse motor and a noise preventive circuit adapted to prevent succeeding inputs from becoming present from that time at which said synchronizing signal is supplied as an input for a given time which is shorter than one period of said synchronizing signal.

5. An electronic timepiece comprising:

a. a time unit signal generator including an oscillator for generating a frequency reference signal and means for forming a time unit signal consisting of a pulse signal having a given frequency from said frequency reference signal;

b. a mechanical time keep means for effecting a time keep operation in accordance with the time unit signal from said time unit signal generator to display a kept time;

an electrical time keep means for effecting a time keep operation independently of said mechanical time keep means in accordance with the time unit signal from said time unit signal generator;

d. a manually operable correction means for correcting the kept time of said electrical time keep means; and e. a synchronizing means including a synchronizing signal generation means for detecting one period of the time keep operation of said mechanical time keep means to generate a synchronizing signal, means for comparing a time required for one period of said synchronizing signal with one period of the time keep operation of said electrical time keep means and means for bringing the kept time of said mechanical time keep means into in coincidence with the kept time of said electrical time keep means in accordance with the result obtained by said comparison means.

6. An electronic timepiece as claimed in claim 5 wherein said comparison means is provided with an input terminal adapted to receive the synchronizing signal from said synchronizing signal generation means and with an input terminal adapted to receive a correction signal from a manually operable correction signal generator means.

7. An electronic timepiece as claimed in claim 5 wherein said kept time coincidence means includes a mechanism for feeding a fast feed signal having a frequency which is higher than the frequency of said time unit signal to said mechanical time keep means until the kept time of said mechanical time keep means coincides with the kept time of said electrical time keep means.

8. An electronic timepiece as claimed in claim 5 wherein said kept time coincidence means is provided with a mechanism for blocking said time unit signal fed to said mechanical time keep means until the kept time of said mechanical time keep means coincides with the kept time of said electrical time keep means.

9. An electronic timepiece as claimed in claim 5 wherein said kept time coincidence means comprises a mechanism for feeding a fast feed signal having a frequency which is higher than the frequency of said time unit signal to said mechanical time keep means until the kept time of said mechanical time keep means coincides with the kept time of said electrical time keep means, a mechanism for blocking said time unit signal fed to said mechanical time keep means until the kept time of said mechanical time keep means coincides with the hold time of said electrical time keep means and a mechanism for selecting either one operation of said two mechanisms.

10. An electronic timepiece comprising:

a. a time unit signal generator including an oscillator for generating a frequency reference signal and means for forming from said frequency reference signal a time unit signal consisting of a pulse signal having a given frequency;

b. a mechanical time keep means for effecting a time keep operation in accordance with the time unit signal from said time unit signal generator;

c. an electrical time keep means for effecting the time keep operation independently of said mechanical time keep means in accordance with the time unit signal from said time unit signal generator;

d. a display means for displaying the time kept by said mechanical time keep means;

e. a manually operable correcting signal generation means;

f. means for correcting the kept time of said electrical time keep means to a standard time by means of the correcting signal from said correcting signal generation means;

g. a synchronizing means including means for detecting the kept time of said mechanical time keep means to generate a synchronizing signal and adapted to select either one of the following operations to coincide respective kept times of said mechanical and electrical time keep means with each other, one of said operations detecting the difference between respective kept time of said mechanical and electrical time keep means when said synchronizing signal is supplied as an input and feeding a correcting signal having a frequency which is higher than the frequency of said time unit signal to said mechanical time keep means until the kept time of said mechanical time keep means coincides with the kept time of said electrical time keep means and another operation blocking said time unit signal fed to said mechanical time keep means until the kept time of said mechanical time keep means coincides with the kept time of said electrical time keep means; and h. a temporary stop means for blocking said time unit signal fed to said electrical and mechanical time keep means only when said temporary stop means is manually operated.

11. An electronic timepiece as claimed in claim 10 wherein said synchronizing pulse generation means includes a manually operable switch, a pulse generation circuit for generating one pulse when said switch is turned on or off and a wave form shape circuit consisting of two latches connected in cascade with each other and adapted to shape the wave form of the output signal from said pulse generation circuit.

12. An electronic timepiece as claimed in claim 1 wherein said correcting signal generation means includes a switch adapted to be turned on-off every one period of the kept time of said mechanical timepiece means, a pulse generation circuit adapted to generate one pulse when said switch is turned on or off and a wave form shape circuit consisting of two latches connected in cascade with each other and adapted to shape the wave form of the output signal from said pulse generation circuit.

13. An electronic timepiece as claimed in claim 10 wherein said correcting signal generation means includes a manually operable switch, a pulse generation circuit for generating one pulse when said switch is turned on or off and a memory means adapted to invert its condition upon receipt of said pulse and hold said inverted condition until correction of the kept time of said electrical time keep means is completed.

14. An electronic timepiece as claimed in claim 10 wherein said corrcting signal generation means includes a manually operable switch, a pulse generation circuit for generating one pulse when said switch is turned on or off and means for generating a correcting signal in a phase related to the phase of said time unit signal.

15. An electronic timepiece as claimed in claim 10 wherein said correcting signal generation means, synchronizing signal generation means and temporary stop means are connected to a selection means adapted to operate said means in the order of predetermined priority when either two of said three means are simultaneously operated.

16. An electronic timepiece as claimed in claim 10 wherein said correcting signal generation means, synchronizing signal generation means and temporary stop means are connected to a selection means adapted, when either one of said means is operating and means having a higher order of predetermined priority becomes operated, to interrupt the operation of the former means so as to operate the latter means in the order of predetermined priority.

17. An electronic timepiece comprising:

a. a time unit signal generator including an oscillator for generating a frequency reference signal and means for forming from said frequency reference signal a time unit signal consisting of a pulse signal having a given frequency;

b. a mechanical time keep means for effecting a time keep operation in accordance with the time unit signal from said time unit signal generator to display its kept time;

c. an electrical time keep means for effecting a time keep operation independently of said mechanical time keep means in accordance with the time unit signal from said time unit signal generator;

d. a time display means for displaying a time kept by said mechanical time keep means;

e. means for comparing respective kept times of said mechanical and electrical time keep means to bring the former kept time into in coincidence with the latter kept time;

f. a manually operable correction means for correcting the kept time of said electrical time keep means; and g. a display means for visually displaying the fact that said time unit signal generator is operating during the correcting operation of said correction means.

18. An electronic timepiece as claimed in claim 17 wherein said display means is a light emitting diode adapted to be ignited and extinguished in synchronism with the frequency of said time unit signal.

* * * * *